US008522978B2

(12) United States Patent
Odabashian

(10) Patent No.: US 8,522,978 B2
(45) Date of Patent: Sep. 3, 2013

(54) STRESS CONCENTRATOR FOR OPENING A FLEXIBLE CONTAINER

(75) Inventor: Robert A. Odabashian, Greer, SC (US)

(73) Assignee: Cryovac, Inc., Duncan, SC (US)

( * ) Notice: Subject to any disclaimer, the term of this patent is extended or adjusted under 35 U.S.C. 154(b) by 603 days.

(21) Appl. No.: 11/749,881

(22) Filed: May 17, 2007

(65) Prior Publication Data

US 2008/0128416 A1 Jun. 5, 2008

Related U.S. Application Data

(60) Provisional application No. 60/868,246, filed on Dec. 1, 2006.

(51) Int. Cl.
*B65D 1/34* (2006.01)
*B65D 6/04* (2006.01)

(52) U.S. Cl.
USPC ..... 206/554; 206/286

(58) Field of Classification Search
USPC ..... 206/554, 279, 286, 442, 497; 383/9, 383/94, 98, 109, 114
See application file for complete search history.

(56) References Cited

U.S. PATENT DOCUMENTS

| | | | | |
|---|---|---|---|---|
| 3,140,038 | A * | 7/1964 | Laguerre | 383/15 |
| 3,391,851 | A | 7/1968 | Nemec | |
| 3,516,537 | A | 6/1970 | Dreyfus et al. | |
| 3,641,732 | A | 2/1972 | Fujio | |
| 4,064,296 | A | 12/1977 | Bornstein et al. | |
| 4,098,406 | A | 7/1978 | Otten et al. | |
| 4,113,139 | A | 9/1978 | Berry et al. | |
| 4,278,738 | A | 7/1981 | Brax et al. | |
| 4,332,327 | A | 6/1982 | Frohwerk et al. | |
| 4,382,513 | A | 5/1983 | Schirmer et al. | |
| 4,755,403 | A | 7/1988 | Ferguson | |
| 4,768,411 | A | 9/1988 | Su | |
| 4,778,058 | A | 10/1988 | Yamazaki et al. | |

(Continued)

FOREIGN PATENT DOCUMENTS

| | | |
|---|---|---|
| EP | 0 192 131 | 8/1986 |
| EP | 0 435 498 | 7/1991 |

(Continued)

OTHER PUBLICATIONS

U.S. Appl. No. 12/152,686, filed May 16, 2008, Dayrit, et al.

(Continued)

*Primary Examiner* — Luan K Bui
*Assistant Examiner* — Rafael Ortiz
(74) *Attorney, Agent, or Firm* — Rupert B. Hurley, Jr.

(57) ABSTRACT

A flexible container including opposing closed first and second edges, a closed third edge and an open side or end. The flexible container may include an unclosed area extending beyond one of the closed edges forming the flexible container. The unclosed area may include a first opening tab and a second opening tab configured to be pulled apart in order to initiate opening of the flexible container. The first opening tab and second opening tab may each include at least two openings. The opening may be positioned so as to channel a stress concentration proximate a heat seal. The flexible container may be formed of multi-layer film having a first outer layer, a second outer layer and directly adhered to the first outer layer an internal layer formed of a blend of at least two resin components that are partially compatible.

19 Claims, 23 Drawing Sheets

(56) References Cited

U.S. PATENT DOCUMENTS

| | | | | |
|---|---|---|---|---|
| 4,838,429 | A | 6/1989 | Fabisiewicz et al. | |
| 4,861,414 | A | 8/1989 | Vogan | |
| 4,886,690 | A | 12/1989 | Davis et al. | |
| 4,889,731 | A | 12/1989 | Williams, Jr. | |
| 4,944,409 | A | 7/1990 | Busche et al. | |
| 4,956,212 | A | 9/1990 | Bekele | |
| 4,958,735 | A | 9/1990 | Odabashian | |
| 5,023,121 | A | 6/1991 | Pockat et al. | |
| 5,126,211 | A | 6/1992 | Mitzutani et al. | |
| 5,127,065 | A | 6/1992 | Wade | |
| 5,290,104 | A * | 3/1994 | Sengewald | 383/25 |
| 5,308,668 | A | 5/1994 | Tsuji | |
| 5,413,412 | A | 5/1995 | Odabashian | |
| 5,540,646 | A | 7/1996 | Williams et al. | |
| 5,545,419 | A | 8/1996 | Brady et al. | |
| 5,556,674 | A | 9/1996 | Meilhon | |
| 5,852,152 | A | 12/1998 | Walton et al. | |
| 5,888,648 | A | 3/1999 | Donovan et al. | |
| 5,908,245 | A | 6/1999 | Bost et al. | |
| 5,966,898 | A | 10/1999 | Su | |
| 6,054,209 | A | 4/2000 | Imanishi et al. | |
| 6,060,137 | A | 5/2000 | Akao | |
| 6,170,696 | B1 * | 1/2001 | Tucker et al. | 220/793 |
| 6,203,867 | B1 | 3/2001 | Derkach et al. | |
| 6,221,410 | B1 | 4/2001 | Ramesh et al. | |
| 6,221,502 | B1 | 4/2001 | Takashige et al. | |
| 6,260,705 | B1 | 7/2001 | Montepiani et al. | |
| 6,270,819 | B1 | 8/2001 | Wiese | |
| 6,296,886 | B1 | 10/2001 | DePoorter et al. | |
| 6,309,104 | B1 | 10/2001 | Koch et al. | |
| 6,361,856 | B1 | 3/2002 | Wakai et al. | |
| 6,383,537 | B1 | 5/2002 | Brady et al. | |
| 6,446,847 | B1 | 9/2002 | Huffer | |
| 6,476,137 | B1 | 11/2002 | Longo | |
| 6,479,137 | B1 | 11/2002 | Joyner et al. | |
| 6,499,598 | B2 | 12/2002 | Montepiani et al. | |
| 6,568,533 | B1 | 5/2003 | Tanaka et al. | |
| 6,663,905 | B1 | 12/2003 | Ennis et al. | |
| 6,698,928 | B2 | 3/2004 | Miller | |
| 6,708,826 | B1 | 3/2004 | Ginsberg et al. | |
| 6,726,364 | B2 | 4/2004 | Perell et al. | |
| 6,764,729 | B2 | 7/2004 | Ramesh et al. | |
| 6,780,373 | B1 | 8/2004 | Musco | |
| 6,790,468 | B1 | 9/2004 | Mize, Jr. et al. | |
| 6,979,494 | B2 | 12/2005 | Berrier et al. | |
| 7,118,792 | B2 | 10/2006 | Hewitt et al. | |
| 7,331,159 | B2 | 2/2008 | Osgood | |
| 7,357,255 | B2 | 4/2008 | Ginsberg et al. | |
| 7,527,839 | B2 | 5/2009 | Busche et al. | |
| 7,919,738 | B2 * | 4/2011 | Su et al. | 219/730 |
| 2002/0172834 | A1 | 11/2002 | Rivett et al. | |
| 2003/0228077 | A1 * | 12/2003 | Laske | 383/66 |
| 2004/0043169 | A1 | 3/2004 | Subramanian et al. | |
| 2004/0109963 | A1 | 6/2004 | Zaggia et al. | |
| 2004/0118735 | A1 | 6/2004 | Mize et al. | |
| 2004/0166262 | A1 | 8/2004 | Busche et al. | |
| 2004/0175464 | A1 | 9/2004 | Blemberg et al. | |
| 2004/0175465 | A1 | 9/2004 | Buelow et al. | |
| 2004/0175466 | A1 | 9/2004 | Douglas et al. | |
| 2004/0175467 | A1 | 9/2004 | Mueller et al. | |
| 2004/0175592 | A1 | 9/2004 | Douglas et al. | |
| 2005/0058793 | A1 | 3/2005 | Schaefer et al. | |
| 2005/0069719 | A1 | 3/2005 | Blemberg et al. | |
| 2005/0118373 | A1 | 6/2005 | Blemberg et al. | |
| 2005/0118374 | A1 | 6/2005 | Douglas et al. | |
| 2005/0207821 | A1 | 9/2005 | Bergey et al. | |
| 2006/0073317 | A1 | 4/2006 | Sato et al. | |
| 2006/0134287 | A1 | 6/2006 | Vimini et al. | |
| 2006/0188619 | A1 | 8/2006 | Vimini et al. | |
| 2006/0199912 | A1 | 9/2006 | Fuchs et al. | |
| 2007/0009699 | A1 | 1/2007 | Hewitt et al. | |
| 2007/0221532 | A1 | 9/2007 | DiLiberto | |
| 2008/0179780 | A1 | 7/2008 | Broadus et al. | |
| 2008/0182051 | A1 | 7/2008 | Broadus et al. | |
| 2008/0182052 | A1 | 7/2008 | Broadus et al. | |
| 2008/0182053 | A1 | 7/2008 | Broadus et al. | |
| 2009/0017239 | A1 | 1/2009 | Ursino | |

FOREIGN PATENT DOCUMENTS

| | | | |
|---|---|---|---|
| EP | 0 940 251 | | 9/1999 |
| EP | 0 957 044 | | 11/1999 |
| EP | 1 295 908 | | 3/2003 |
| EP | 1 607 345 | A1 | 12/2005 |
| EP | 1 769 908 | | 4/2007 |
| FR | 2 849 835 | | 7/2004 |
| GB | 1 270 281 | | 4/1972 |
| GB | 2 397 065 | | 7/2004 |
| JP | 1153733 | | 6/1989 |
| JP | 7009550 | A | 1/1995 |
| JP | 7125756 | A | 5/1995 |
| JP | 7299853 | A | 11/1995 |
| JP | 7299857 | A | 11/1995 |
| JP | 7299859 | A | 11/1995 |
| JP | 9052966 | A | 2/1997 |
| JP | 9053008 | | 2/1997 |
| JP | 9111060 | A | 4/1997 |
| JP | 9141791 | A | 6/1997 |
| JP | 10 237 234 | A | 9/1998 |
| JP | 63 275644 | | 11/1998 |
| JP | 2833970 | B2 | 12/1998 |
| JP | 2000169597 | A | 6/2000 |
| JP | 2001064456 | A | 3/2001 |
| JP | 3356200 | | 12/2002 |
| JP | 2003201377 | A | 7/2003 |
| JP | 2003327255 | A | 11/2003 |
| JP | 2003 341687 | | 12/2003 |
| JP | 2006063134 | | 3/2004 |
| JP | 2005161671 | | 6/2005 |
| JP | 02006240717 | A | 9/2006 |
| JP | 2008024744 | | 2/2008 |
| WO | WO 99/54398 | | 10/1999 |
| WO | WO 2007/082347 | | 7/2007 |
| WO | WO 2007/088005 | | 8/2007 |
| WO | WO 98/28132 | | 7/2008 |

OTHER PUBLICATIONS

U.S. Appl. No. 12/313,396, filed Nov. 20, 2007, Compton, et al.

ASTM D 638-00, Standard Test Method for Tensile Properties of Plastics, pp. 1-13.

ASTM D 882-90, Standard test Methods for Tensile Properties of Thin Plastic Sheeting, pp. 194-199.

ASTM D 2732-03, Standard Test Method for Unrestrained Linear Thermal Shrinkage of Plastic Film and Sheeting, pp. 1-5.

ASTM D 3763-95A, Standard Test Method for High Speed Puncture properties of Plastics Using Load and Displacement Sensors, Peak Load Impact Strength, pp. 1-6.

ASTM D 4065-01, Standard Practice for Plastics: Dynamic Mechanical properties: Determination and Report of Procedures, pp. 1-5.

ASTM D 5026-95a, Standard Test Method for Measuring the dynamic Mechanical properties of Plastics in Tension, pp. 1-4.

International Search Report and Written Opinion for International Application No. PCT/US2008/006444 mailed Aug. 5, 2009.

International Search Report and Written Opinion for International Application No. PCT/US2009/003023 mailed Sep. 4, 2008.

Patel, Saaavedra, Hinton and DeGroot, Comparison of EVA and Polyolefin Plastomer as Blend Components in Various Film Applications, Journal of Plastic Film and Sheeting, vol. 14, pp. 344-355 (Oct. 1998).

Surround™ Shrink Bags with Lift & Peel Opening Technology, Curwood Bemis product brochure (undated)__).

Wu, et al., "Study on the Morphology and Properties of Metallocene Polyethylene and Ethylene/Vinyl Acetate Blends", Journal of Applied Polymer Science, vol. 91, 905-910 (2004).

* cited by examiner

STRESS CONCENTRATOR FOR OPENING A FLEXIBLE CONTAINER

CROSS-REFERENCE TO RELATED APPLICATIONS

This application is related to commonly owned Provisional Application Ser. No. 60/868,246, filed Dec. 1, 2006, incorporated herein by reference in its entirety, and claims the benefit of its earlier filing date under 35 U.S.C. 119(e).

FIELD OF THE INVENTION

This invention relates to a flexible container of thermoplastic material, such as a bag or pouch, which concentrates stress near or at a heat seal when a user pulls on opening tabs.

BACKGROUND OF THE INVENTION

Food and other items are often packaged in flexible containers of thermoplastic material, such as pre-formed bags with one end open through which the product to be packaged is inserted into the bag, or pouches that are formed of a flat or folded film sealed around the product to be packaged, which are then closed by heat-sealing the open end(s).

Particularly with food products, the flexible container is often made of heat-shrinkable thermoplastic material. In such a case, the product is loaded into the flexible container, then air is removed from the container and the open end of the container is closed by a heat-sealing step. Finally, the sealed and vacuumized package is submitted to heat-treatment so as to get the shrink of the packaging material tightly around the packaged product. The opening of vacuumized and shrunk bags may present a real problem, particularly if no cutting tools are available. Therefore, it is desirable to provide the flexible container with a so-called easy-opening feature, i.e., a feature or a combination of features that would enable the end user to easily open the package by hand.

U.S. Pat. No. 3,516,537 addresses this problem by creating a tab in the skirt of a heat-shrinkable bag extending beyond the factory seal of the bag, by means of a cut at a right angle to the factory seal. To open the package, the tab is gripped with the fingers of one hand and pulled up and across the bottom of the package, while the packaged product is held with the other hand. The entrance edge of the tab, being directed at a right angle to the seal, will tear into and through the factory seal. As the tab is pulled across the package, the package will tear open predominantly following the sealed seam. This solution, however, can only be employed with products that would not be damaged by a certain pressure, such as the pressure exerted by pulling up the tab with one hand while keeping down the product with the other or that specifically illustrated in U.S. Pat. No. 3,516,537.

A similar approach, with similar drawbacks, has been described in U.S. Pat. No. 3,641,732, where a laminated tear tab extending outwardly and substantially perpendicular to the package is formed by the fusion of a suitable portion of the wrapping material.

A different approach has been followed in U.S. Pat. Nos. 3,391,851 and 5,413,412 where a tear tab is sealed over a perforation line on a heat-shrunk container or on a heat-shrinkable bag. The drawbacks of these solutions are related to the risk that the accidental detachment of the adhered tear tab would expose the perforations and, thus, lead to a loss of vacuum within the package.

Still another approach has been described in U.S. Pat. No. 4,958,735. It provides for the adhesion of a thick strip of non shrinkable thermoplastic material adhered to the un-shrunk portion of an otherwise shrunk package, with the thick strip bearing a weakness line dividing it into two manually graspable sections to be used as tear tabs and pulled into the opposite directions to open the package. While this system has certain advantages, for instance there is no need to keep the packaged product from moving while opening the package and there are no risks for the packaged product if the tear tabs detach from the bag, the manufacture of such a package would be complicated and difficult on an industrial scale. Furthermore, the opening of the package will occur through a tear of the shrunk film in the longitudinal direction, effectively destroying the whole container.

There is, therefore, still a need for flexible containers provided with improved easy-opening.

SUMMARY OF THE INVENTION

It is thus desirable to provide an easy-openable flexible container of thermoplastic material that can be sealed in a tight, hermetic manner to safely secure the packaged product, can be employed for the packaging of any type of products, and can be manufactured easily.

In one embodiment of the invention, a flexible container includes a plastic film formed into an enclosure for receiving a product and defining at least one openable portion and a seal closing the openable portion of the enclosure. The seal closing the openable portion of the enclosure may be a heat seal. The flexible container includes at least one opening tab extending beyond the seal outside of the enclosure. Also, the flexible container includes at least two openings defined in the opening tab and wherein at least one of the openings is graspable by a user, the openings being arranged to concentrate opening stress on the seal so that the seal is torn and the flexible container is opened when the tabs are pulled by the user. The flexible container may include first and second opening tabs with at least two openings each, such as three openings each. The flexible container may include at least one opening that has rounded edges or is a slit.

In another embodiment, the two or more of the openings are sized to receive at least one finger of a user and are positioned adjacent to each other to define a stressed film region between the openings, and wherein the stressed film region concentrates opening stress on the seal so that the seal is torn and the flexible container is opened when the tabs are pulled by the user. The stressed film region may define a minimum width between adjacent openings, where the minimum width of the stressed film region has a tensile strength that exceeds the force required of the user to open the container. The film of the flexible container may have a thickness between about 0.001 inches and 0.006 inches. The force required to open the container may be less than 14 pounds-force.

In still another embodiment, the flexible container includes a seal defining a seal direction. Each adjacent opening may define a third edge extending between the inner edge and the guide edge. The two adjacent openings define an inner edge and a guide edge. The inner edge extends generally perpendicular to the seal direction and generally parallel to the inner edge of the adjacent opening so as to define a stressed film region between the openings. In this embodiment, the guide edge is adjacent to the inner edge for receiving a finger of a user and guiding that finger towards the inner edge of the opening so that the stressed film region concentrates opening stress on the seal and the flexible container is opened when the tabs are pulled by the user. The guide edges of each of the adjacent openings may define an acute angle with the respective inner edges of the opening so as to define a generally wedge-shaped opening.

DEFINITIONS

Figure 1:
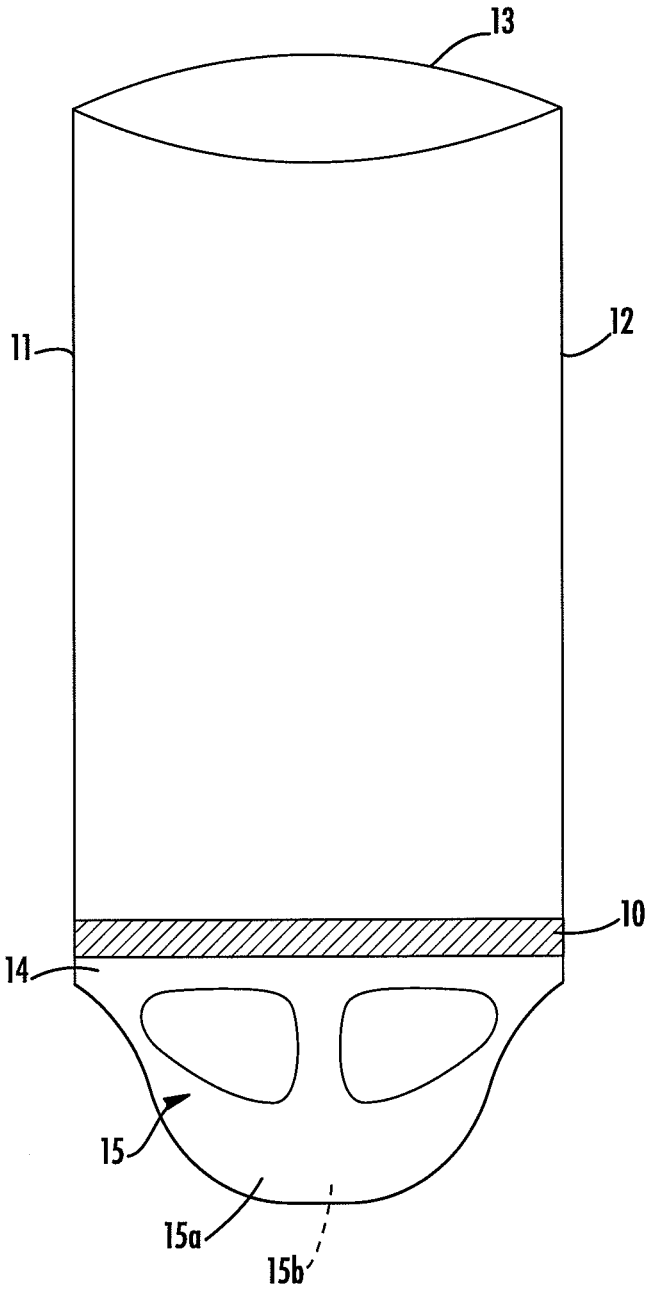
FIG. 1 is a top view of an end-seal bag according to an embodiment of the present invention.

As used herein, the term "film" is used in a generic sense to include any flexible plastic web, regardless of whether it is film or sheet. Typically, films of and used in the present invention may have a thickness of 0.001 inches to 0.006 inches, more preferably 0.0015 inches to 0.004 inches, and more preferably 0.0018 inches to 0.003 inches.

As used herein the term "flexible container" is inclusive of end-seal bags, which have an open top, seamless (i.e., folded, unsealed) side edges, and a seal across the bottom of the bag, transverse-seal bags, which have an open top, a seamless bottom edge and each of the side edges with a seal therealong, and L-sealed bags, which have an open top, a sealed bottom, one transverse-seal along a first side edge and a seamless second side edge.

As used herein, the phrases "inner layer" and "internal layer" refer to any film layer having both of its principal surfaces directly adhered to another layer of the film.

As used herein, the phrase "outer layer" refers to any film layer having only one of its principal surfaces directly adhered to another layer of the film.

As used herein, the phrase "innermost layer", when referring to the multi-layer film used in the manufacture of the flexible container, means the outer layer of said multi-layer film which in the end package will be closest to the packaged product relative to the other layers of the film.

As used herein, the phrase "outermost layer", when referring to the multi-layer film used in the manufacture of the flexible container, means the outer layer of said multi-layer film which in the end package will be furthest from the packaged product relative to the other layers of the film.

As used herein, the phrase "sealing layer" refers to an outer layer involved in the sealing of the film to itself.

As used herein, the term "core" and the phrase "core layer", refer to any inner film layer that may have a function other than serving as an adhesive or compatibilizer for adhering two layers to one another.

As used herein, the phrase "tie layer" refers to any inner film layer having the primary purpose of adhering two layers to one another.

As used herein, the phrases "heat-shrinkable," "heat-shrink," and the like, refer to the tendency of the film to shrink upon the application of heat, i.e., to contract upon being heated, such that the size of the film decreases while the film is in an unrestrained state. As used herein said term refer to films with a free shrink in each of the machine and the transverse directions, as measured by ASTM D 2732, of at least 5% at 95° C.

As used herein, the term "polymer" refers to the product of a polymerization reaction, and is inclusive of homo-polymers, and co-polymers, whereas the term "co-polymer" refers to polymers formed by the polymerization reaction of at least two different monomers, thus including, for example, ter-polymers.

As used herein, the phrase "heterogeneous polymer" refers to polymerization reaction products of relatively wide variation in molecular weight and relatively wide variation in composition distribution, i.e., typical polymers prepared, for example, using conventional Ziegler-Natta catalysts.

As used herein, the phrase "homogeneous polymer" refers to polymerization reaction products of relatively narrow molecular weight distribution and relatively narrow composition distribution. Homogeneous polymers are structurally different from heterogeneous polymers, in that homogeneous polymers exhibit a relatively even sequencing of co-monomers within a chain, a mirroring of sequence distribution in all chains, and a similarity of length of all chains, i.e., a narrower molecular weight distribution. This term includes those homogeneous polymers prepared using metallocene, or other single-site type catalysts, as well as those homogenous polymers that are obtained using Ziegler Natta catalysts in homogenous catalysis conditions.

As used herein, the term "polyolefin" refers to any polymerized olefin, which can be linear, branched, cyclic, aliphatic, aromatic, substituted, or unsubstituted. More specifically, included in the term polyolefin are homo-polymers of olefin, co-polymers of olefin, co-polymers of an olefin and a non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-α-olefin co-polymer, propylene-α-olefin co-polymer, butene-α-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

As used herein, the term "modified polyolefin" is inclusive of modified polymer prepared by co-polymerizing the homo-polymer of the olefin or co-polymer thereof with an unsaturated carboxylic acid, e.g., maleic acid, fumaric acid or the like, or a derivative thereof such as the anhydride, ester or metal salt or the like. It is also inclusive of modified polymers obtained by incorporating into the olefin homo-polymer or co-polymer, by blending or by grafting, an unsaturated carboxylic acid, e.g., maleic acid, fumaric acid or the like, or a derivative thereof such as the anhydride, ester or metal salt or the like.

As used herein, the phrase "ethylene-α-olefin copolymer" refers to such heterogeneous materials as linear low density polyethylene (LLDPE) with a density usually in the range of from about 0.915 g/cm$^3$ to about 0.930 g/cm$^3$, linear medium density polyethylene (LMDPE) with a density usually in the range of from about 0.930 g/cm$^3$ to about 0.945 g/cm$^3$, and very low and ultra low density polyethylene (VLDPE and ULDPE) with a density lower than about 0.915 g/cm$^3$; and homogeneous polymers such as metallocene-catalyzed EXACT™ and EXCEED™ homogeneous resins obtainable from Exxon, single-site AFFINITY™ resins obtainable from Dow, and TAFMER™ homogeneous ethylene-α-olefin copolymer resins obtainable from Mitsui. All these materials generally include co-polymers of ethylene with one or more co-monomers selected from ($C_4$-$C_{10}$)-α-olefin such as butene-1, hexene-1, octene-1, etc., in which the molecules of the copolymers include long chains with relatively few side chain branches or cross-linked structures.

As used herein, the term "adhered", as applied to film layers, broadly refers to the adhesion of a first layer to a second layer either with or without an adhesive, a tie layer or any other layer therebetween. In contrast, as used herein, the phrase "directly adhered" is defined as adhesion of the subject layer to the object layer, without a tie layer, adhesive, or other layer therebetween. As used herein, the word "between", as applied to a layer expressed as being between two other specified layers, includes both direct adherence of the subject layer to the two other layers it is between, as well as a lack of direct adherence to either or both of the two other layers the subject layer is between, i.e., one or more additional layers can be imposed between the subject layer and one or more of the layers the subject layer is between.

As used herein the term "gas-barrier" when referred to a layer or to an overall structure, is used to identify layers or structures characterized by an Oxygen Transmission Rate (evaluated at 23° C. and 0% R.H. according to ASTM D-3985) of less than 500 cm$^3$/m$^2$.day.bar.

DETAILED DESCRIPTION OF THE PRESENT INVENTION

The present invention will now be described more fully hereinafter with reference to the accompanying drawings, in which embodiments of the invention are shown. The invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to the Figures, FIG. 1 is a top view of an end-seal bag according to an embodiment of the present invention. FIG. 1 shows the bottom heat seal 10 of the bag, 11 and 12 are the side folded edges, 13 is the open mouth of the bag, 14 is the skirt beyond the bottom heat seal 10 and 15 is that part of the skirt 14 where the unsealed rear and front panels (15*a* and 15*b*) are suitably shaped to be separately graspable and, thus, usable as opening tabs.

Figure 2:
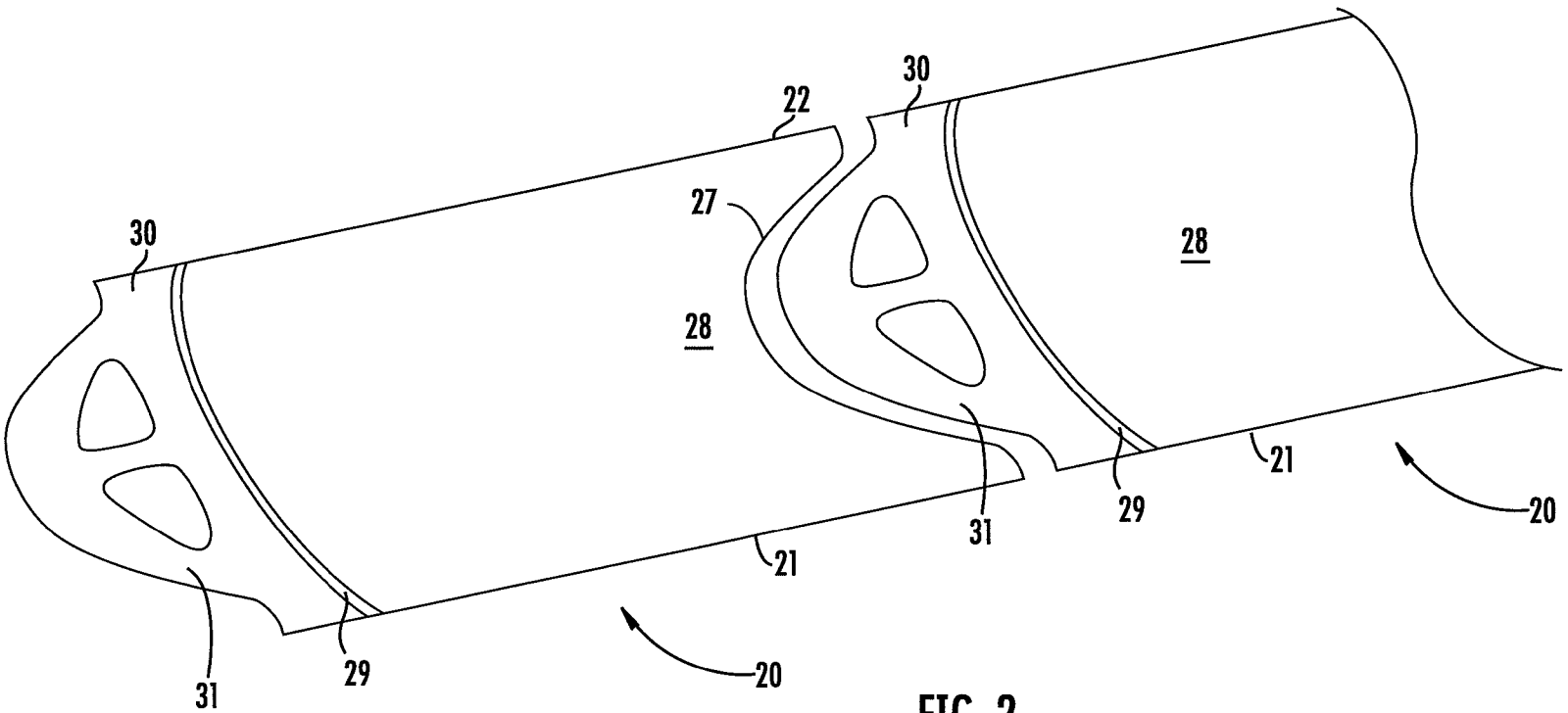
FIG. 2 is a top view of a tubing from which the end-seal bags of FIG. 1 are manufactured by using a suitably selected cutting profile.

FIG. 2 is a perspective view of a lay-flat tubing from which the bag of FIG. 1 is made. In said FIG. 2, 20 is the seamless tubing in a lay-flat configuration, 21 and 22 are the side folded edges of the tubing, 29 is the end seal of the bag 28, which may be 1/16 of an inch wide, 30 is the skirt of the same bag 28 which extends beyond the heat seal, 31 is the opening tab of bag 28, i.e., the area in said skirt 30 where the two unsealed rear and front panels may be separately grasped by the user and pulled apart to open the bag 28, and 27 is the mouth of the bag 28. The bags may be separated from tubing by the processing machinery and the opening tabs 31 cut at the same time or nearly the same time.

Figure 3:
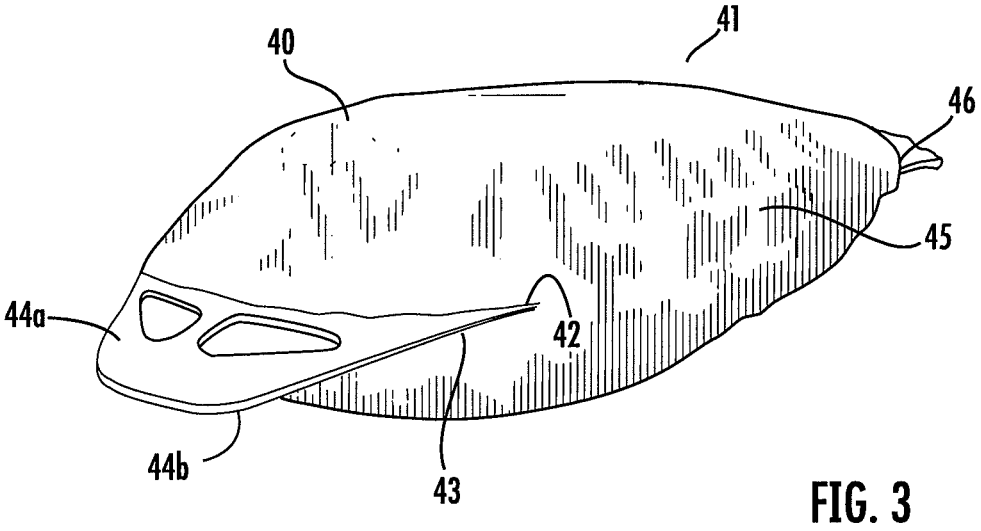
FIG. 3 is a perspective view of a shrunk bag where the starting bag is the bag of FIG. 1.

FIG. 3 represents a perspective view of a package obtained from a bag according to FIG. 1, where the package is shrunk following vacuumization and heat-sealing of the bag mouth. In said FIG. 3, 40 is the product packaged, 41 is the bag, 42 is the bottom heat seal, 43 is the skirt extending beyond the bottom heat seal, 44*a* and 44*b* are the two opening tabs in the rear and front panels of the shrunk bag that will be pulled in laterally opposite directions to initiate and propagate opening of the bag, 45 is one of the two folded side edges and 46 is the top seal to close the bag.

Figure 4:
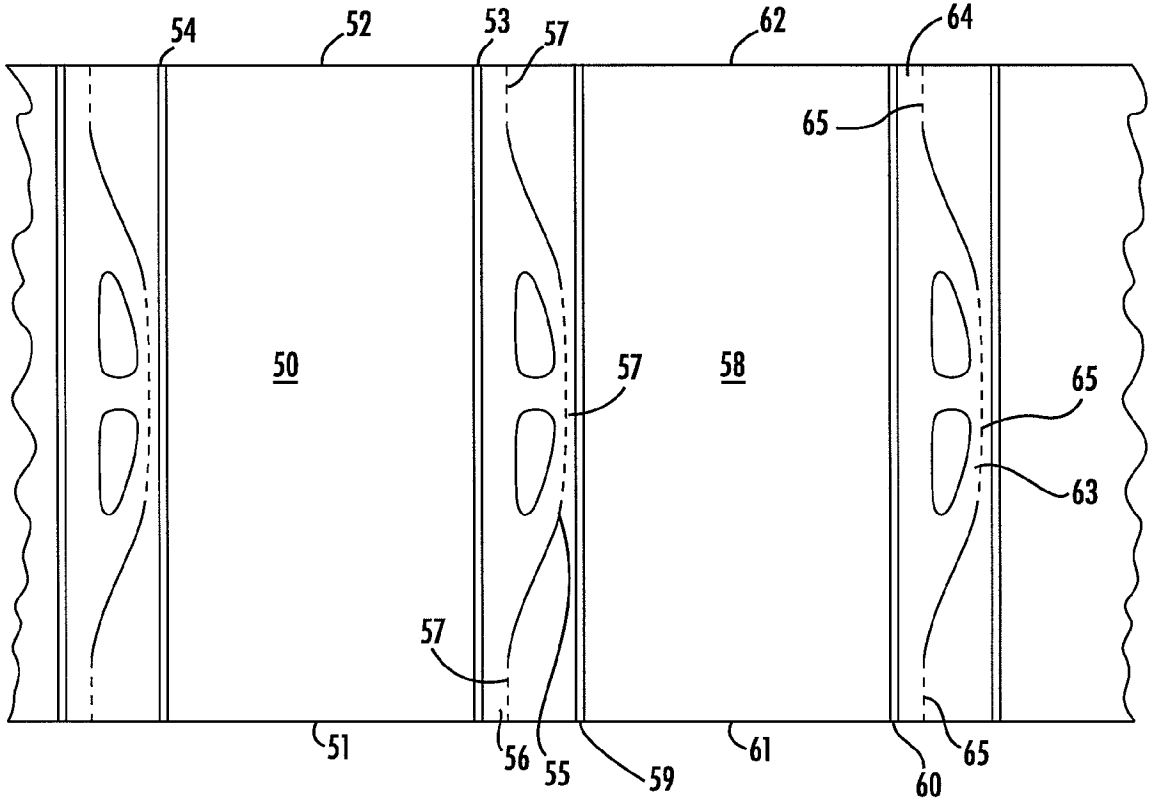
FIG. 4 is a top view of a series of transverse-seal bags according to the present invention with a side opening tab.

FIG. 4 is a top view of a series of transverse-seal bags, where 50 is a first transverse-seal bag, 51 is the bottom folded edge, 52 is the open mouth of bag 50, 53 and 54 are the side seals of bag 50, 55 are the tabs cut into the side skirt 56 extending beyond the heat side seal 53, 57 are the perforated edges separating said bag 50 and the next bag 58, 59 is one side seal of bag 58, the other being indicated with numeral 60, 61 is the folded bottom edge of bag 58, and 62 is the open mouth, 63 is the tab cut into the side skirt 64 extending beyond the heat side seal 60, and 65 are the perforations between said bag 58 and the next one, not illustrated in said Figure. It should be noted that the perforation edges 57,65 may extend about the entire length of the tabs 55,63 edges or in various other perforation edge arrangements, such as perpendicular across the bag or segments of the tab edges.

Figure 5:
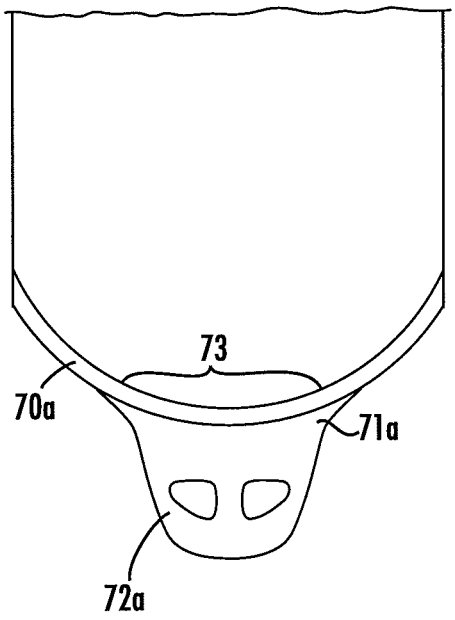
FIG. 5 is a representational top view of a particular shape of possible opening tabs.

FIG. 5 is a top view of details of an end-seal bag according to an embodiment of the invention, wherein the profile of an opening tab is illustrated. In this Figure, 70*a* indicates the bottom heat seal of the end-seal bag, 71*a* is the skirt extending beyond the heat seal and 72*a* is a shape for the opening tab in the superposed panels.

As illustrated in the previous figures, the opening tabs may have a limited dimension as this will allow concentration of the force of the user to initiate breaking of the seal and, therefore, opening of the flexible container, in a direction generally perpendicular to the direction in which the tabs are pulled. The opening tabs may have a size suitable to be grasped by the hands of the user and may extend beyond the heat seal only along a portion of the heat seal length, typically not exceeding 50%, sometimes not exceeding 30% and sometimes not exceeding 20% of the length of the heat seal. With reference to the FIG. 5, 73 indicates the length of the heat seal along which the opening tabs respectively extend. In all those cases, the opening tabs are of a size suitable to allow grasping by the hands of the user, while the length of the heat seal along which they extend, as well their positioning, may vary to a great extent.

As illustrated in FIGS. 6*a*-6*m*, the opening tabs 100 may include openings 110, which may be holes and/or partially cut holes, also referred to as slits, having hanging chads 111. Each opening tab 100 may include two or more openings 110. While FIGS. 6*a*-6*m* show a few different shapes and sizes for openings 110, the openings 110 may be other shapes and sizes. The dimensions shown for opening tabs 100 in FIGS. 6*a*, 6*c*, 6*e*, 6*g*, 6*i*, and 6*k* are exemplary and represent pre-shrink dimensions. Likewise, the positioning of the openings 110 may include other configurations than those seen in FIGS. 6*a*-6*m*. Generally, the openings 110 are large enough so that at least one finger of the user may fit inside at least one of the openings 110. For example, for the embodiment shown in FIG. 6*a*, the central opening CO is large enough for a user's finger to fit therein. However, the openings adjacent AO to the central opening CO need not be large enough for a user's finger.

Figure 6A:
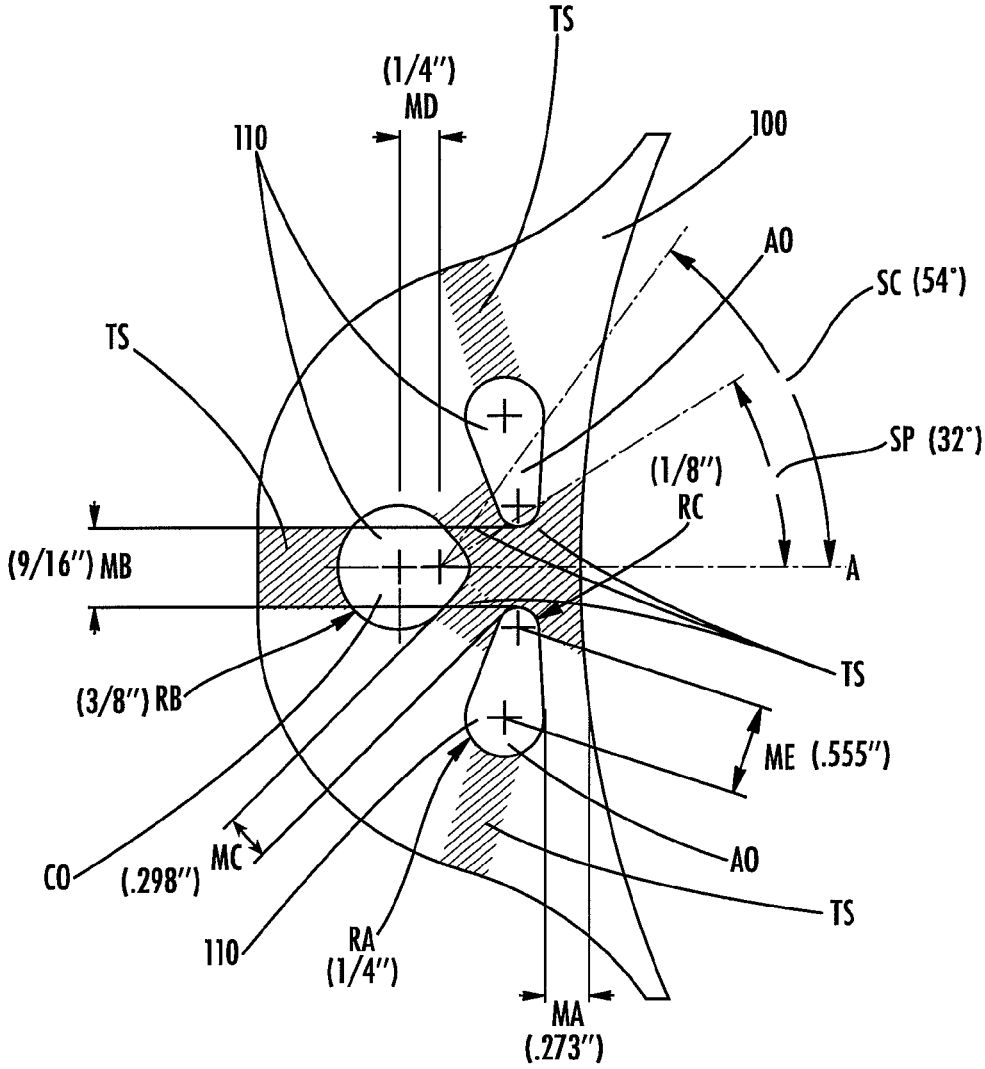
FIGS. 6*a* to 6*m* are top views of opening tabs with openings according to embodiments of the present invention.
Figure 6B:
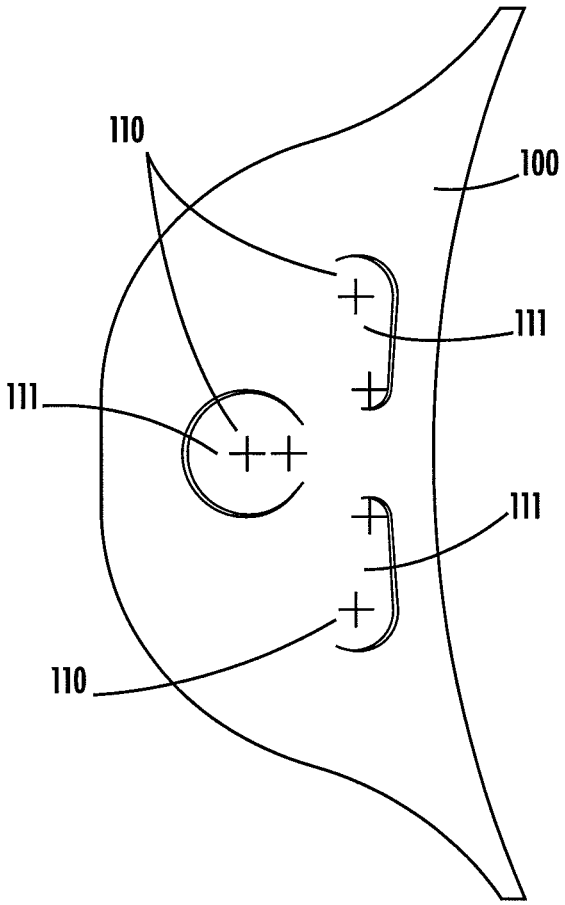
Figure 6C:
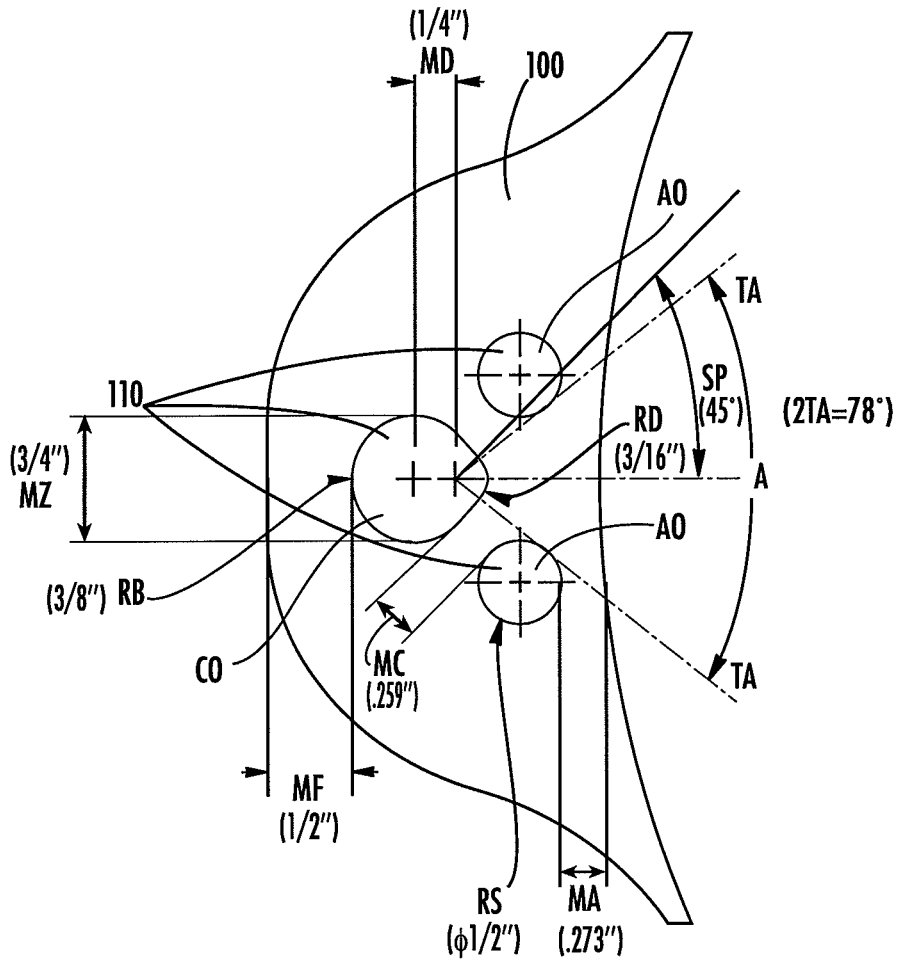
Figure 6D:
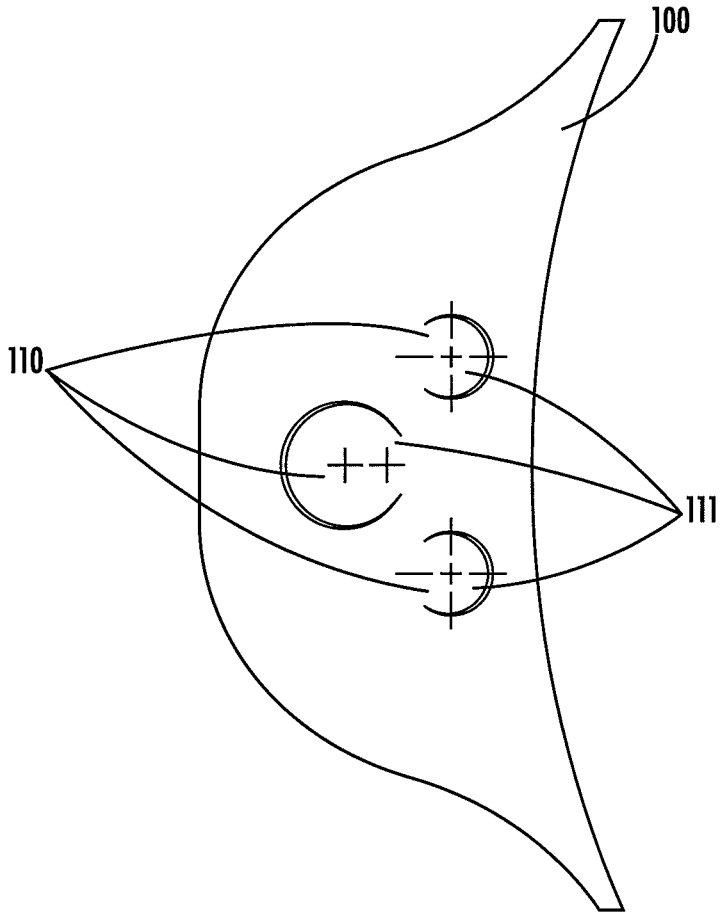
Figure 6E:
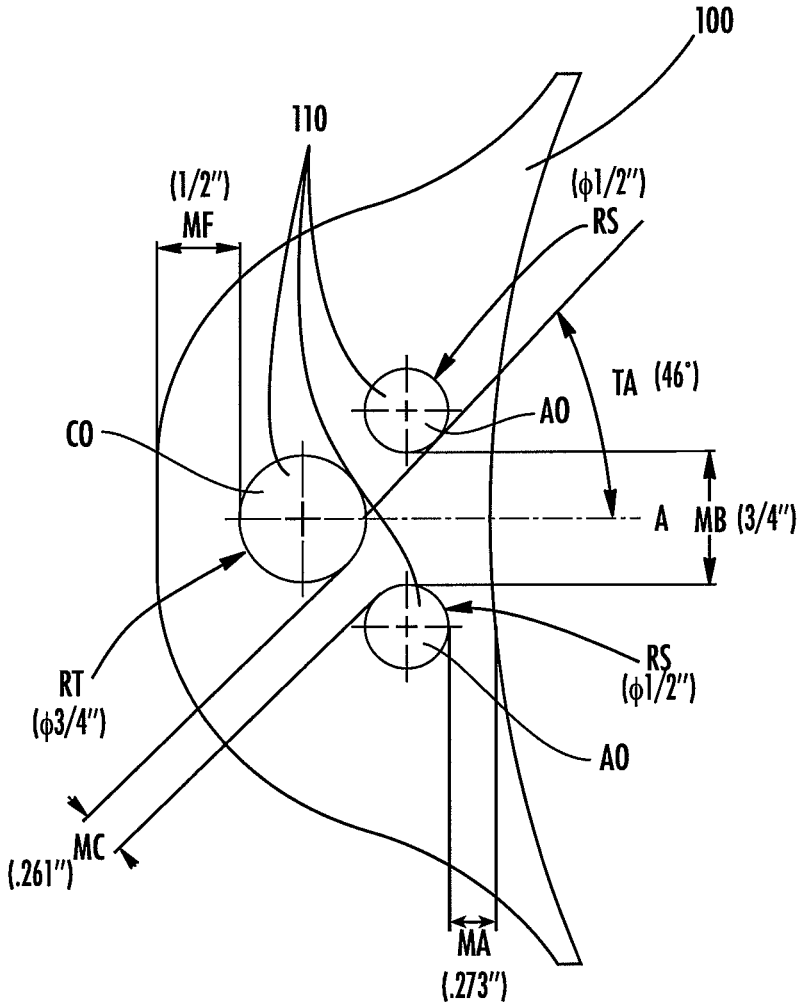
Figure 6F:
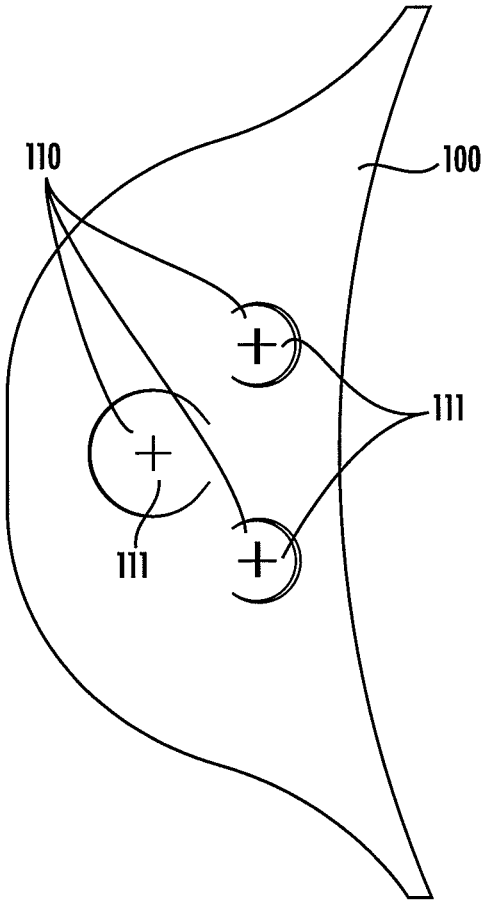
Figure 6G:
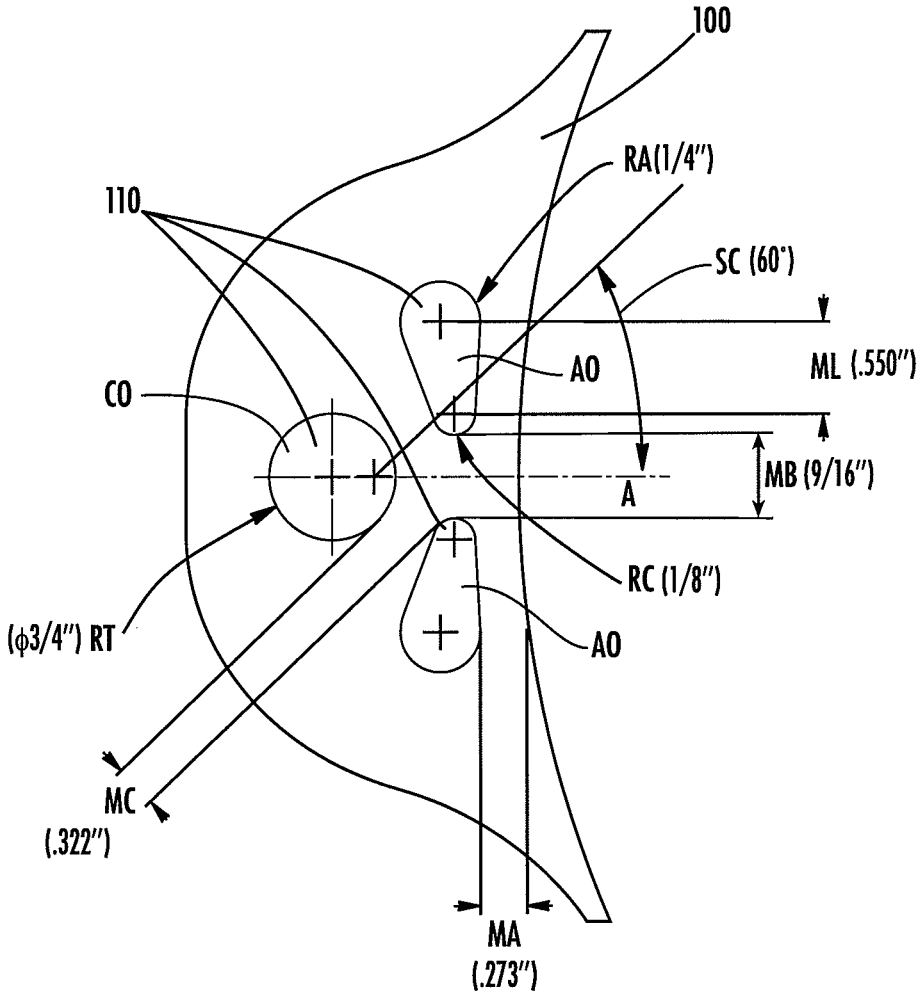
Figure 6H:
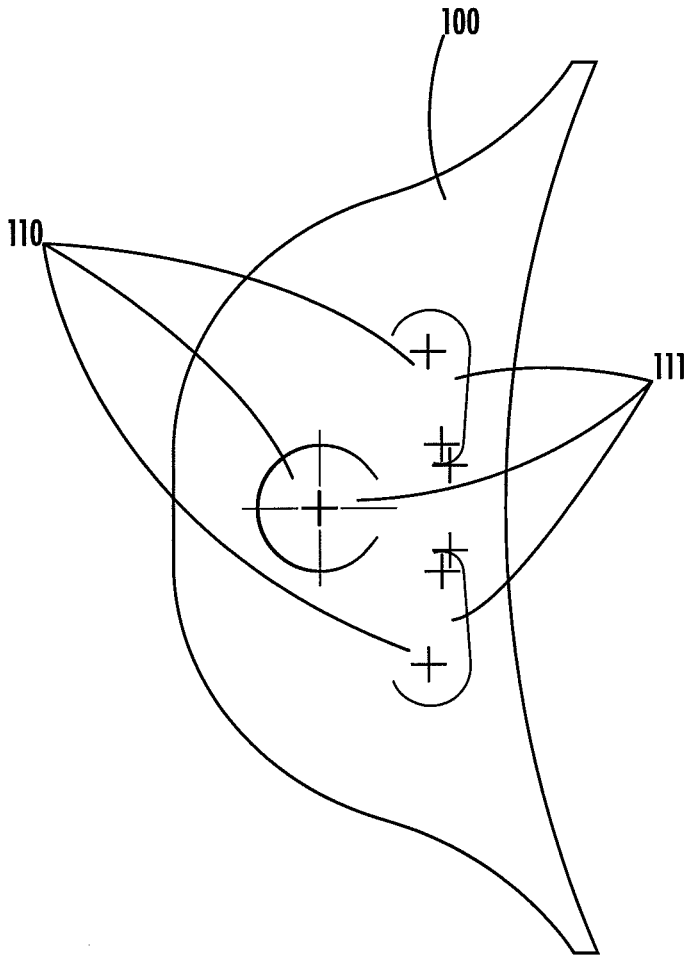
Figure 6I:
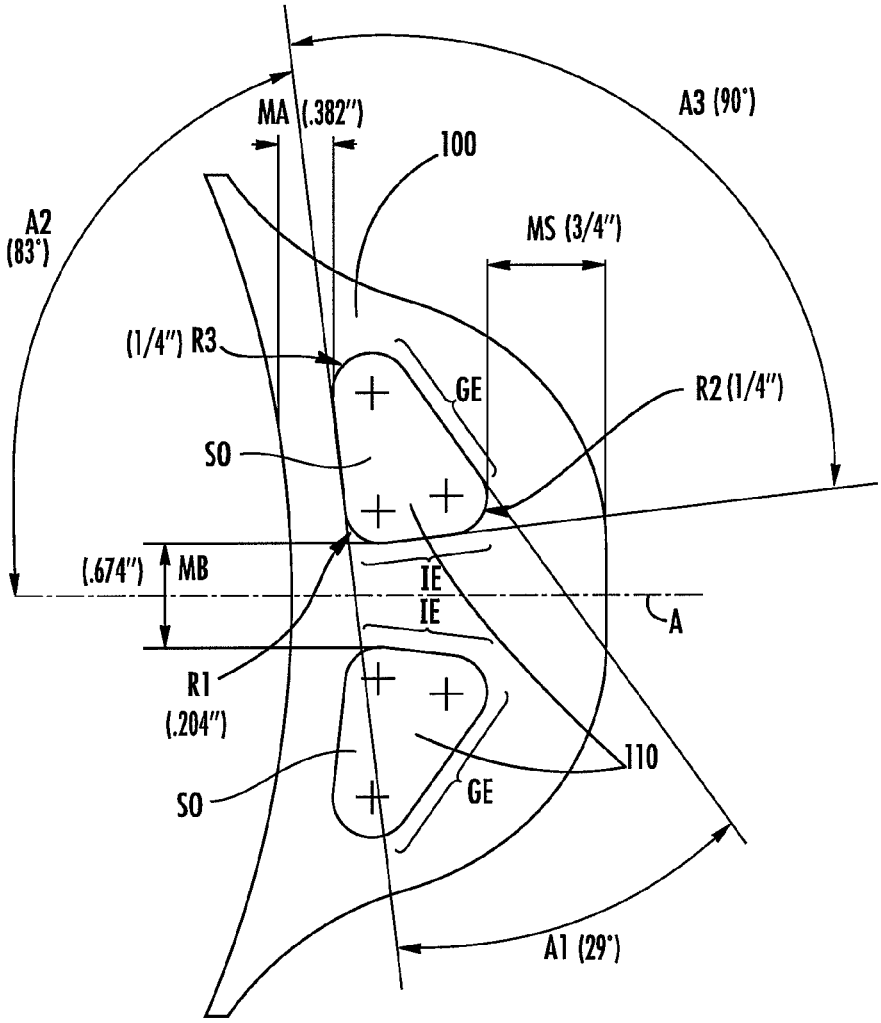
Figure 6J:
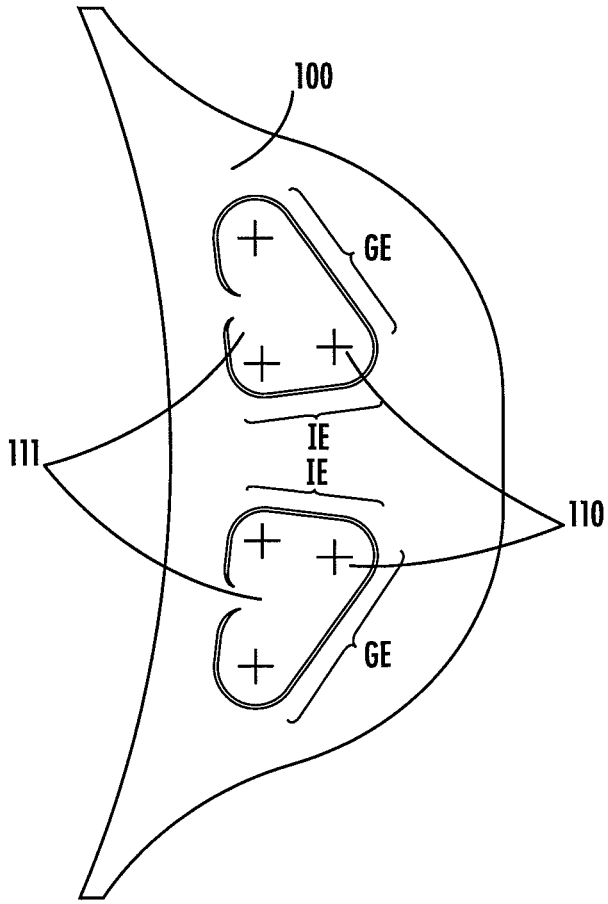
Figure 6K:
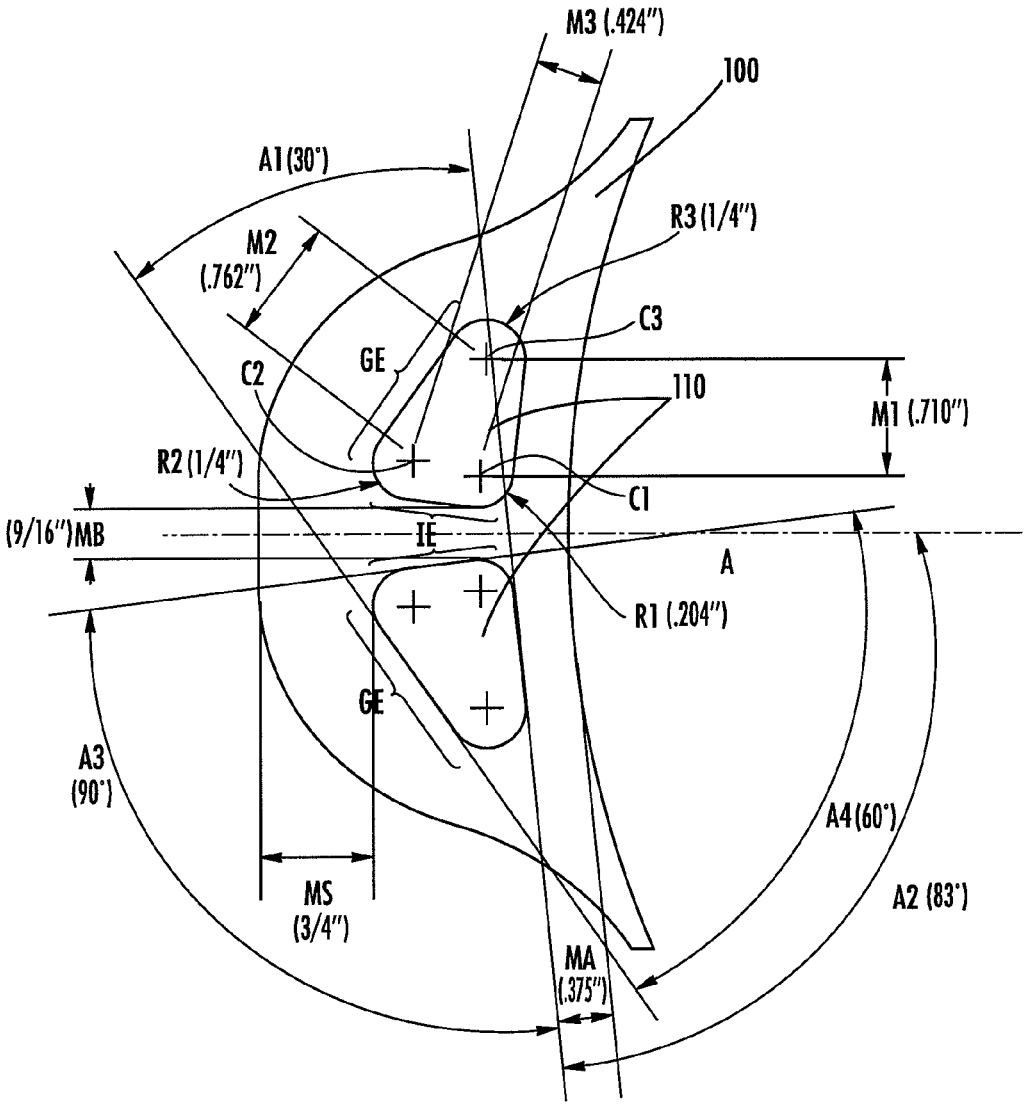
Figure 6L:
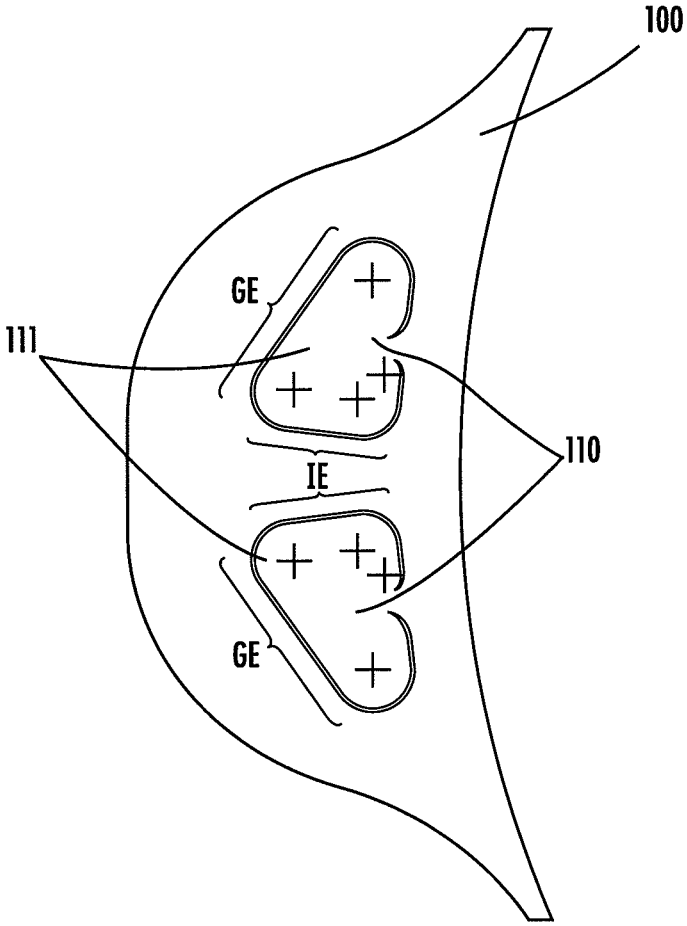
Figure 6M:
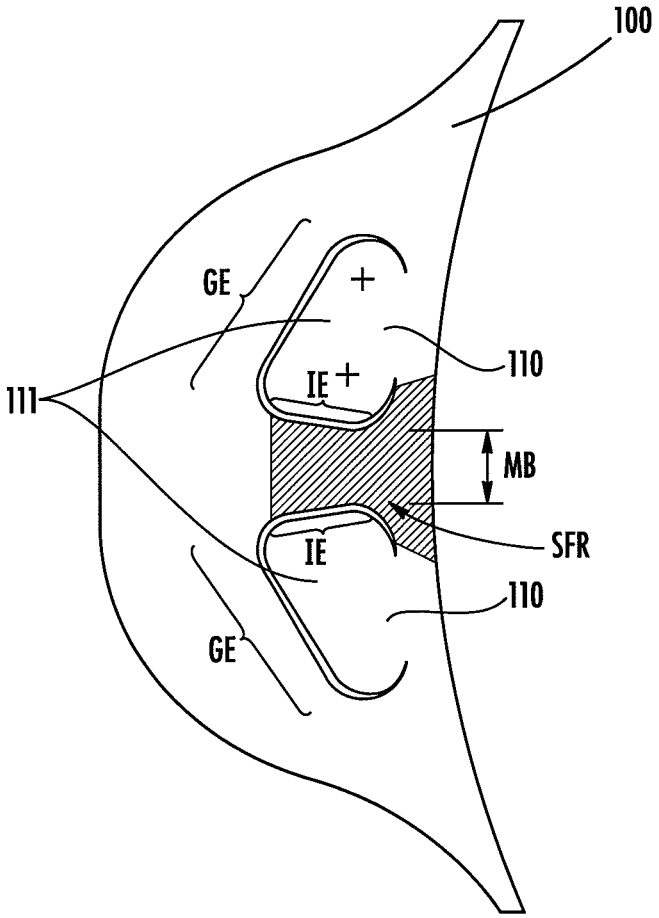

As shown in FIG. 6*m*, for example, two openings 110 may be sized to receive at least one finger and positioned adjacent to each other so as to define a stressed film region between the openings. When the openings 110 are pulled, the stressed film region concentrates opening stress on the seal so that the seal is delaminated and the flexible container is opened. The shaded region SFR is the stressed film region of the opening tab 100. The stressed film region may define a minimum width between adjacent openings. In FIG. 6*m*, distance MB is the minimum width between adjacent openings. The minimum width MB may be 9/16 of an inch. In one embodiment, the minimum width of the stressed film region has a tensile strength that exceeds the force required of the user to open the container, which may be fourteen pounds force. Fourteen pounds force is the maximum force that should be required of a user to open the container. A lower opening force means the package is easier to open but increases the probability of compromising package integrity during shipping, etc. A stress concentrator for bag tabs enables easy opening of a bag having a high seal strength. The openings 110 may have inner edges IE that are generally perpendicular to the seal direction and generally parallel to each other. The openings 110 may have guide edges GE adjacent to the inner edges. The guide edges guide a user's finger towards the inner edge of the opening when the user pulls on the tabs so that the stressed film region concentrates opening stress on the seal. The openings 110 may have a third edge that extends between the inner edge and the guide edge so as to define a generally triangular or wedge shape.

When the package is to be opened, the end user takes the package by the opening tabs 100 and pulls them in laterally opposite directions. The user may configure his or her fingers within or through the openings 110 of respective opening tabs 100 and pull in laterally opposite directions. The seal adjacent to the opening tab will then be opened by tearing through the heat seal, which may include breaking the heat-sealing layer, through the cohesive failure layer in the sealing area, and again breaking the heat-sealing layer below the sealing area but leaving the other layers unaffected as further discussed below.

The openings 110 are positioned on the opening tab 100 in a manner that channels the stress caused by a user pulling on the opening tab 100. By pulling the opposing tabs directly apart using the openings 110, stress is concentrated on that portion of the seal between the openings 110, as well as on a portion between the respective openings 110 and the seal. The stress may be channeled so that a stress concentration occurs near or at the heat seal, which is advantageous by making it easier to break the heat seal. The size and shape of the openings 110 affects how the stress is distributed across the opening tab 100 and heat seal. The stress distribution across the opening tab 100 may be a limitation to the size, shape, and configuration of openings 110 about the tab 100. Basically, the tensile strength of the opening tab 100 should not be exceeded by the stress on certain portions of the opening tab 100 caused by a user pulling on the opening tab. In FIG. 6*a*, for instance, the areas marked TS are portions of the opening tab 100 where the tensile stress is the highest due to the positioning of the openings 110. The openings 100 may be configured about opening tab 100 in order to avoid creating high stress areas on opening tab 100. In FIG. 6*a*, openings 110 may be positioned so that an angle SP defined by the centerline A of the tab 100 and the edge of the opening 110 closest to the centerline A of the tab 100 is less than forty-five degrees, such as thirty-two degrees. Also, openings 110 may be positioned so that an angle SC defined by the centerline A of tab 100 and the center of the opening 110 is at least forty-five degrees, such as fifty-four degrees.

The positioning and number of the openings 110 on the opening tab 100 can be determined by testing the tabs with a commercial tensile tester, such as an Instron apparatus. The Instron apparatus is commercial equipment in which samples are clamped in jaws. The jaws can separate at a predetermined rate. The force required to peel the bag during this movement of the jaws is recorded. A set of freely movable "fingers" can be fabricated in order to simulate a user's fingers and test the series of bags with openings 110.

The testing procedure includes filling bags with water and sealing the bags. The bags, which are intended to simulate a packaged food product, may then be inserted into flexible containers according to the present invention. The flexible containers are vacuumized and sealed, then sent through a heat-shrink tunnel. After cooling, the flexible containers are carefully removed so as not to disturb the opening tabs. The opening tabs of the flexible containers are then placed on the appropriate parts of the equipment and then the devices are activated to begin pulling. In the case of the Instron testing apparatus, the pull is at a controlled rate.

The results of tests using the Instron testing apparatus are provided below. The opening tabs with two holes are designated as "2H." The opening tabs with one hole are designated as "1H." The opening tabs with no holes are designated "NH."

Chart 1 shows the maximum amount of pound-force recorded by the Instron testing apparatus, which occurs when the seal first begins to separate. Low seal power, medium seal power, and high seal power refers to the energy used to seal the bags for testing. In this case, the low seal power was 125 Joules of energy, the medium seal power was 135 Joules of energy, and the high seal power was 145 Joules of energy.

CHART 1

Instron Pull Test

| | Low Seal Power | | | Med Seal Power | | | High Seal Power | | |
|---|---|---|---|---|---|---|---|---|---|
| | 2H | 1H | NH | 2H | 1H | NH | 2H | 1H | NH |
| Raw | 10.77 | 7.42 | 6.49 | 5.71 | 9.16 | 7.85 | 9.85 | 6.75 | 9.58 |
| Data | 7.71 | 6.27 | 6.50 | 6.88 | 8.92 | 8.83 | 6.01 | 8.46 | 8.57 |
| (lbf) | 10.11 | 6.37 | 9.55 | 6.80 | 7.51 | 9.86 | 6.58 | 10.72 | 8.56 |
| | 8.74 | 7.77 | 10.25 | 6.80 | 7.89 | 8.51 | 7.97 | 7.82 | 8.11 |
| | 6.5 | 5.62 | 7.65 | 7.31 | 7.33 | 6.91 | 6.02 | 5.20 | 7.93 |
| | 5.74 | 7.88 | 8.50 | 5.70 | 8.06 | 7.17 | 6.77 | 7.69 | 6.63 |
| | 5.45 | 8.94 | 10.14 | 6.31 | 7.90 | 6.57 | 5.86 | 9.89 | 9.20 |
| | 7.13 | 7.57 | 9.51 | 5.45 | 9.15 | 6.09 | 6.88 | 6.51 | 7.62 |
| | 5.95 | 7.47 | 9.46 | 6.12 | 7.23 | 9.48 | 7.65 | 8.09 | 8.91 |
| | 5.22 | 6.31 | 6.91 | 5.76 | 6.74 | 9.67 | 6.97 | 7.75 | 9.56 |
| Average | 7.33 | 7.16 | 8.49 | 6.28 | 7.99 | 8.09 | 7.06 | 7.89 | 8.47 |

Chart 2 shows the statistical comparisons between the no hole, one hole, and two hole tabs depending upon the seal power level. The t-test was used to determine whether there was a statistical difference, or unequal variances, between the pull test results of different tabs for a particular seal power.

CHART 2

Statistical Comparisons

| | | | | |
|---|---|---|---|---|
| Low Seal | 2H | vs | 1H | No Statistical Difference |
| Power | 2H | vs | NH | No Statistical Difference |
| | 1H | vs | NH | Statistically Different |
| Med Seal | 2H | vs | 1H | Statistically Different |
| Power | 2H | vs | NH | Statistically Different |
| | 1H | vs | NH | No Statistical Difference |
| High Seal | 2H | vs | 1H | No Statistical Difference |
| Power | 2H | vs | NH | Statistically Different |
| | 1H | vs | NH | No Statistical Difference |

Figure 7A:
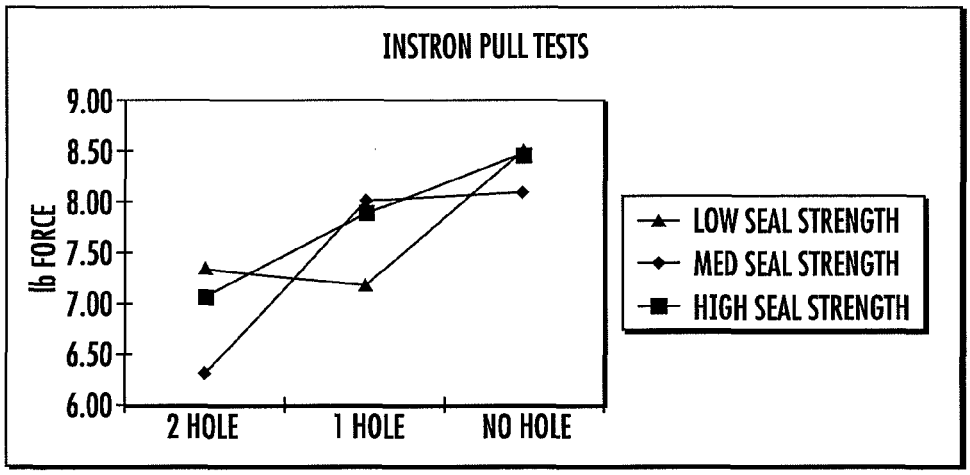
FIG. 7*a* is a graph of average pound-force values using an Instron tensile-testing apparatus on 2 hole, 1 hole, and no hole opening tabs.

In FIG. 7*a*, a graphical representation shows the average values recorded by the Instron testing apparatus for 2 hole, 1 hole, and no hole opening tabs under low, medium, and high seal power. FIG. 7*a* shows that the 2 hole opening tab has the lowest recorded values for the high and medium seal strength.

Figure 7B:
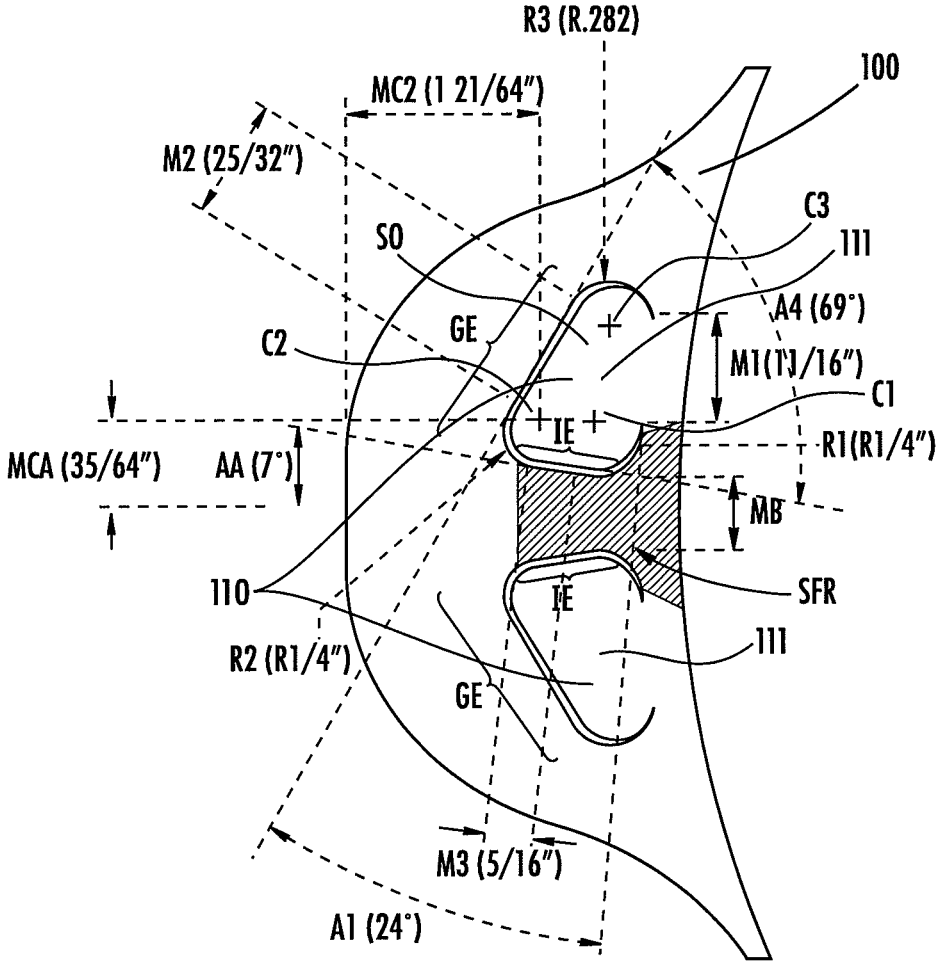
FIGS. 7*b*-7*d* are top views of the opening tabs used in Instron testing.
Figure 7C:
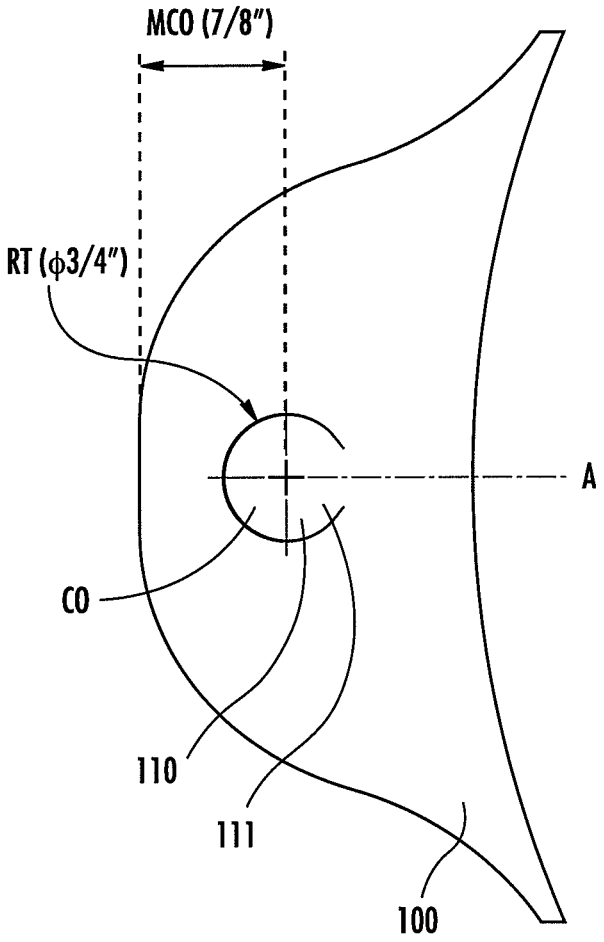
Figure 7D:
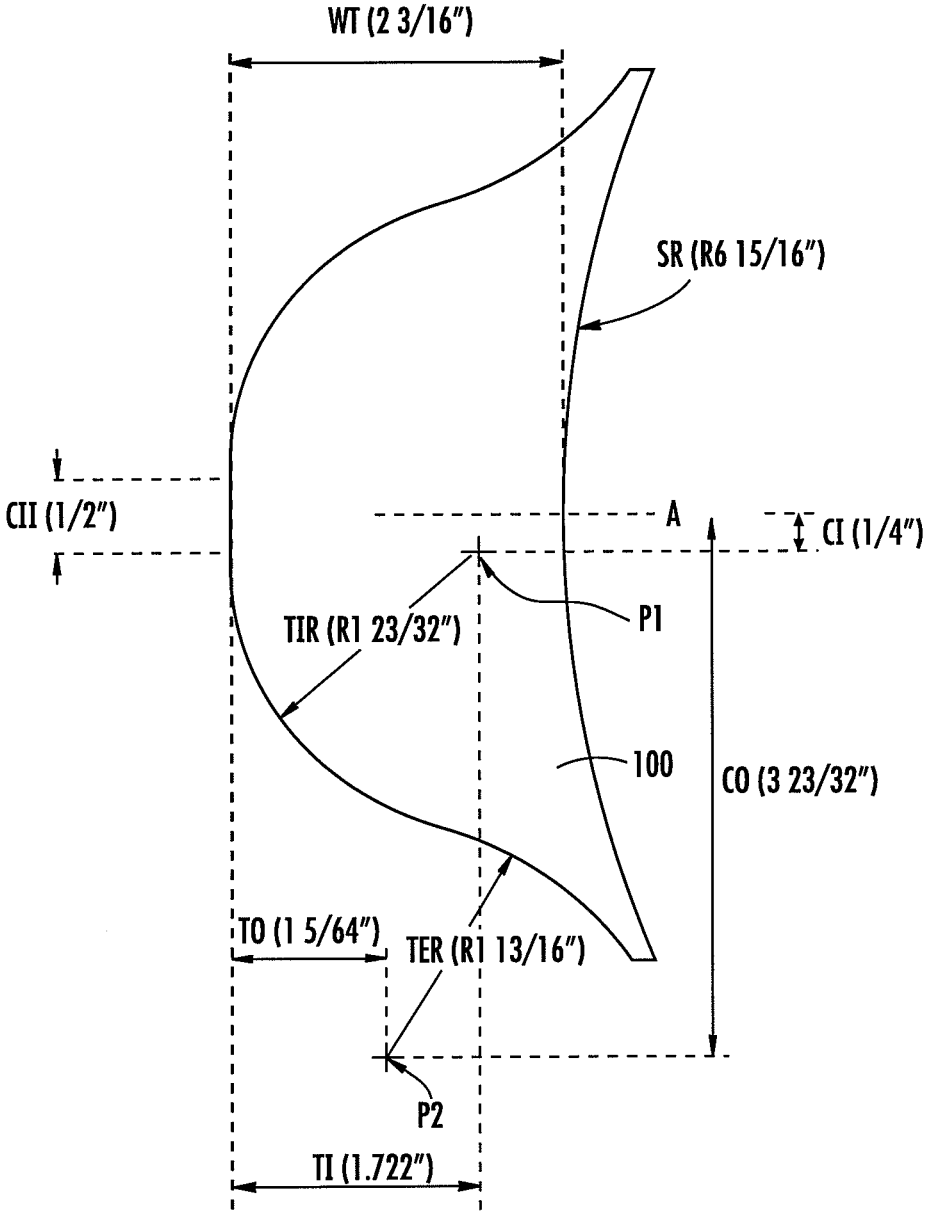

FIGS. 7*b-d* show the pre-shrink dimensions of the opening tabs 100 used in the testing described above. The film used for these opening tabs may have a tensile strength in the longitudinal direction of 12,800 psi and in the transverse direction of 10,200 psi. In FIG. 7*b*, the two hole opening tab 100 tested as "2H" above is shown. The angle A1 defined by two edges of side opening SO that run roughly perpendicular to the centerline A was 24 degrees. The distance M3 between center point C1 and center point C2 was five-sixteenths of an inch. The radii R2 and R1 were one-fourth of an inch each. The angle AA defined by the side of opening SO closest to the centerline and the centerline A was seven degrees. The distance MCA between center point C2 of side opening SO and the centerline A was 35/64 of an inch. The distance MC2 between center point C2 of side opening SO and the edge of the tab opposite the seal was 1 and 21/64 inches. The distance M2 between the center point C2 and center point C3 was 25/32 of an inch. The radius R3 of a portion of a side opening SO that is furthest from centerline A was 0.282 inches. The angle A4 defined by the edges of side opening SO closest to centerline A and furthest edge from the seal was 69 degrees. The distance M1 between the center point C1 and center point C3 was eleven-sixteenths of an inch. The minimum width MB between the openings 110 was 9/16 of an inch. The stressed film region SFR is indicated in FIG. 7*b* as the shaded region between the openings 110 and a region between each opening 100 and the seal.

In FIG. 7*c*, the one hole opening tab 100 tested as "1H" above is shown. The radius RT of circular central opening CO was three-fourths of an inch. The distance MCO between the center of the central opening CO and the edge of the opening tab 100 opposite the seal was seven-eighths of an inch.

In FIG. 7*d*, the no hole opening tab 100 tested as "NH" above is shown. The width WT of the opening tab 100 along the centerline A was 2 and three-sixteenths inches. The distance CI between the centerline A and the center point P1 was one-fourth of an inch. The distance T1 between the center point P1 and the edge of the opening tab 100 opposite the seal was 1.722 inches. The radius TIR defined by the center point P1 and the end portion of the opening tab 100 opposite the seal was 1 and 23/32 inches. The distance CO between the centerline A and the center point P2 was 3 and 23/32 inches. The distance TO between the center point P2 and the bottom edge of the opening tab 100 parallel to the centerline A was 1 and 5/64 inches. The radius TER defined by the center point P2 and the side portion of opening tab 100 was 1 and 13/16 inches. The distance CII between center point P1 and a different center point mirrored across the centerline A was one-half of an inch. The radius SR defined by the seal portion of the opening tab 100 was 6 and 15/16 inches.

FIGS. 6*a*, 6*c*, 6*e*, 6*g*, 6*i*, and 6*k* show additional examples of dimensions of opening tabs 100. In FIG. 6*a*, the distance MB between adjacent openings AO may be about one-half of an inch, the distance MA between an adjacent opening AO and the edge of the opening tab 100 proximate the seal can be 0.273 inches, and the distance MC between an adjacent opening AO and a central opening CO may be 0.298 inches. The distance MD between the center of central opening CO and the center of the opening tab 100 may be one-fourth of an inch and the distance ME between the radial centers of arcs of adjacent opening AO may be 0.555 inches. In FIG. 6*a*, the radius RA of one portion of an adjacent opening AO may be one-fourth of an inch and the radius RC of another portion of an adjacent opening AO may be one-eighth of an inch. The radius RB of a portion of the central opening CO may be three-eighths of an inch. As discussed above, the angle SC may be 54 degrees and the angle SP may be 32 degrees.

In FIG. 6*c*, the distance MF between the edge of central opening CO and the edge of the opening tab 100 that is opposite the seal may be one-half an inch. The distance MC between the central opening CO and an adjacent opening AO may be 0.259 inches. The distance MA between an adjacent opening AO and the edge of the opening tab 100 proximate the seal can be 0.273 inches. The radius RB of a portion of the central opening CO may be three-eighths of an inch. The width MZ of the central opening CO may be three-fourths of an inch and the distance MD between the center of central opening CO and the center of the opening tab 100 may be one-fourth of an inch. In FIG. 6*c*, the radius of circular adjacent openings RS may be one-fourth of an inch. Openings 110 may be positioned so that an angle SP defined by the centerline A of the tab 100 and the edge of the opening 110 closest to the centerline A of the tab 100 may be 45 degrees. The radius RD of the arc about the center of the tab 100 may be three-sixteenths of an inch. The angle TA defined by the centerline A of the tab 100 and a line that runs from the center of the tab 100 to a tangent of an adjacent opening AO may be 39 degrees.

In FIG. 6*e*, the distance MF between the edge of central opening CO and the edge of the opening tab 100 that is opposite the seal may be one-half an inch. The distance MC between the central opening CO and an adjacent opening AO may be 0.261 inches. The distance MA between an adjacent opening AO and the edge of the opening tab 100 proximate the seal can be 0.273 inches. In FIG. 6*e*, the radius RT of circular central opening CO may be three-eighths of an inch and the radius RS of circular adjacent opening may be one-fourth of an inch. The angle TA defined by the centerline A of the tab 100 and a line that runs from the center of the tab 100 to a tangent of an adjacent opening AO may be 46 degrees. The distance MB between adjacent openings AO may be three-fourths of an inch.

In FIG. 6*g*, the distance MC between the central opening CO and an adjacent opening AO may be 0.322 inches. The distance MA between an adjacent opening AO and the edge of the opening tab 100 proximate the seal can be 0.273 inches. In FIG. 6*g*, the radius RT of circular central opening CO may be three-eighths of an inch. The radius RA of one portion of an adjacent opening AO may be one-fourth of an inch and the radius RC of another portion of an adjacent opening AO may be one-eighth of an inch. The distance MB between adjacent openings AO may be one-half of an inch. Openings 110 may be positioned so that an angle SC defined by the centerline A of tab 100 and the center of the opening 110 may be 60 degrees. The distance ML between the centers of portions of adjacent opening AO may be 0.550 inches.

In FIG. 6*i*, the distance MS between the edge of side opening SO and the edge of the opening tab 100 that is opposite the seal may be three-fourths of an inch. The distance MA between a side opening SO and the edge of the opening tab 100 proximate the seal can be 0.382 inches. The distance MB between side openings SO may be 0.674 inches. The radius RI of a portion of a side opening SO that is closest to centerline A may be 0.204 inches. The radius R3 of a portion of a side opening SO that is furthest from centerline A may be one-fourth of an inch. The radius R2 of a portion of a side opening SO that is further from the center line A than the portion containing R1 but closer than the portion containing R3 may be one-fourth of an inch. The angle A1 defined by two edges of side opening SO that run roughly perpendicular to the centerline A may be 29 degrees. The angle A2 defined by the centerline A and the edge of side opening SO that is closest to the seal may be 83 degrees. The angle A3 defined by the edges of side opening SO closest to the seal and closest to centerline A may be 90 degrees.

In FIG. 6*k*, the distance MS between the edge of side opening SO and the edge of the opening tab 100 that is opposite the seal may be three-fourths of an inch. The distance MA between a side opening SO and the edge of the opening tab 100 proximate the seal can be 0.375 inches. The distance MB between side openings SO may be three-eighths of an inch. The radius R1 of a portion of a side opening SO that is closest to centerline A may be 0.204 inches. The radius R3 of a portion of a side opening SO that is furthest from centerline A may be one-fourth of an inch. The radius R2 of a portion of a side opening SO that is further from the center line A than the portion containing R1 but closer than the portion containing R3 may be one-fourth of an inch. The angle A1 defined by two edges of side opening SO that run roughly perpendicular to the centerline A may be 30 degrees. The angle A2 defined by the centerline A and the edge of side opening SO that is closest to the seal may be 83 degrees. The angle A3 defined by the edges of side opening SO closest to the seal and closest to centerline A may be 90 degrees. The angle A4 defined by the edges of side opening SO closest to centerline A and furthest edge from the seal may be 60 degrees. The distance M1 between the center point C1 and center point C3 may be 0.710 inches. The distance M2 between the center point C2 and center point C3 may be 0.762 inches. The distance M3 between center point C1 and center point C2 may be 0.424 inches.

The openings 110 may be formed by cutting the opening tab 100 material using saw tooth punches, steel rule dies, or by a rotary die. The openings 110 may be formed individually or at the same time. The hanging chads 111 are formed by cutting a portion of the opening tab 100 without cutting completely around to the location where the cutting commenced.

The hanging chad 111 is generally advantageous because additional equipment is not needed to remove what would be a free chad. Therefore, the hanging chad 111 is beneficial for manufacturing purposes. The openings 110 may have rounded corners in order to reduce stress concentrations about the edges of the openings 110. It should be noted that only one opening tab 100 may be necessary to open the flexible container. For example, a user may hold a portion of the flexible container in one hand while pulling the opening tab 100 in the other hand causing the seal to propagate and/or delaminate.

In packaging, the product may be loaded into a heat-shrinkable flexible container made of the film of the invention, the flexible container may normally be evacuated, and the open end thereof may be closed by heat-sealing, creating opening tabs in the skirt extending beyond the seal closing the open mouth if opening tabs extending beyond any of the heat seals are not already present in the pre-formed flexible container. Following vacuumization and heat-sealing, the packaging material may be heat shrunk by applying heat. This can be done, for instance, by immersing the filled flexible container into a hot water bath or conveying it through a hot water shower or a hot air tunnel, or by infrared radiation. The heat treatment may produce a tight wrapping that closely conforms to the contour of the product therein.

Figure 8:
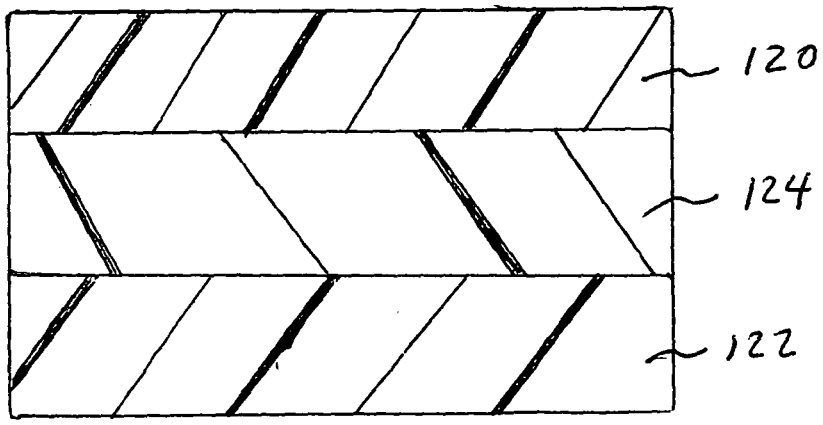
FIG. 8 is a schematic of a cross-sectional view of a multi-layer film suitable for use in the easy-peelable, hermetically heat-sealable flexible container of the present invention.

The multi-layer heat-shrinkable film that can suitably be employed for the manufacture of the easy-peelable and hermetically sealable flexible container of the present invention contains at least three layers, a first outer heat-sealing layer (a), a second outer layer (b) and, directly adhered to the heat-sealing layer (a), an internal cohesive failure layer (c). This film is illustrated in the cross-sectional view of FIG. 8, which illustrates first outer heat-sealing layer 120, second outer layer 122, and directly adhered to heat-sealing layer 120, internal cohesive failure layer 124.

The internal cohesive failure layer (c) includes a blend of at least two resin components that are only partially compatible so that said layer (c) will fail, by an internal rupture substantially along a plane parallel to the layer itself, when a transversal force of from about 4 to about 9.5 N/25.4 mm is applied thereto. Blends of polymer components that can be used for layer (c) are, for instance, those described in EP-B-192,131, namely an ionomer with a melt flow index lower than 5 and a modified ethylene-vinyl acetate copolymer with a remarkably higher melt flow index, whereby the melt flow indices of the two polymers in said layer (c) differ by at least 10; or those described in WO 99/54398 including three components, i.e., a copolymer of ethylene and acrylic or methacrylic acid and an ionomer, a modified EVA and a polybutene; or those described in US 2002/0172834 which include polybutene, an ionomer, and EVA or an alkyl ester of (meth)acrylic acid in suitable proportions. The whole content of these documents is incorporated herein by reference.

Blends for layer (c) may be those including from about 35 wt. % to about 80 wt. % of a copolymer of ethylene and acrylic or methacrylic acid and, in particular, an ionomer, from about 15 wt. % to about 30 wt. % of a modified ethylene-vinyl acetate, and from about 2 wt. % to about 50 wt. % of a polybutene.

Blends for layer (c) may be those including from about 40 wt. % to about 70 wt. % of an ionomer, from about 15 wt. % to about 30 wt. % of a modified ethylene-vinyl acetate, such as an ethylene-vinyl acetate carbon monoxide copolymer, and from about 10 wt. % to about 30 wt. % of a polybutene.

Other blends of only partially compatible resins may be employed for layer (c) provided, however, they will lead to a breakage of the layer when a transversal force of from about 4 to about 9.5 N/25.4 mm is applied thereto. If layer (c) does fail when a transversal force lower than about 4 N/25.4 mm is applied thereto, the flexible container obtained from the film containing such layer might not withstand the pressure exerted in the loading step by the most conventional automatic loading systems and, therefore, there might be leakages in the packages made thereby. If layer (c) fails only when a transversal force higher than about 9.5 N/25.4 mm is applied thereto, the package obtained from the multi-layer film containing such layer (c) might not be easy-openable.

The force required to break such a layer (c) is measured in accordance with ASTM F88-94 using specimens 25.4 mm in width and 300 mm in length made by heat-sealing two strips of a three-layer film where layer (c) is sandwiched between two thin polyolefin layers. The two strips are manually separated until their edges may be fixed, respectively, into the lower and upper clamps of an Instron testing apparatus. The Instron testing apparatus is then started, at a crosshead speed of 30 cm/min with a full-scale load of 2 kg, and the specimen is peeled apart by delaminating layer (c) into two portions.

According to the present invention, the heat-sealable layer (a) of the multi-layer film suitable for the manufacture of the easy-openable flexible container may include one or more resins independently selected from the group including polyethylene homo-polymer, heterogeneous or homogeneous ethylene-α-olefin copolymer, ethylene-vinyl acetate co-polymer, ethylene-ethyl acrylate co-polymer, ethylene-butyl acrylate co-polymer, ethylene-methyl acrylate co-polymer, ethylene-ethyl methacrylate co-polymer, ethylene-butyl methacrylate co-polymer, ethylene-methyl methacrylate co-polymer, ethylene-acrylic acid co-polymer, ethylene-methacrylic acid co-polymer, ionomer and blends thereof in any proportion. Resins may be ethylene-vinyl acetate copolymers, linear ethylene-α-olefin copolymers, homogeneous or heterogeneous, and blends of two or more of these resins. Resins for the heat-sealable layer (a) may include homogeneous and heterogeneous ethylene-α-olefin copolymers with a density comprised between about 0.890 and about 0.925 g/cm$^3$, and with a density between about 0.895 and about 0.915 g/cm$^3$ and blends thereof in any proportions. The resins for the heat-sealable layer (a) may have a seal initiation temperature≦110° C., a seal initiation temperature≦105° C., or a sealing initiation temperature≦100° C.

Heat-sealable layer (a) may be the innermost layer in the end package and the layer involved in the heat-sealing of the film to itself for the manufacture of the flexible container and of the end package. The thickness of the first outer layer (a) may not be higher than 20 μm, not higher than 18 μm, or not higher than 15 μm. Typically, it has a thickness higher than 6 μm and may be higher than 8 μm in order to provide for a hermetic seal. Representative thickness values for the heat-sealable layer (a) are in the range 10-15 μm.

For the other outer layer (b), which may be the outermost layer in the flexible container and in the end package, any thermoplastic material can be employed, such as any polyolefin, modified polyolefin or any blend thereof. Polyamides or copolyamides and polyesters or copolyesters may also be employed.

The polyamide/copolyamide resins that could be used for the outer layer (b) may be aliphatic nylons e.g., nylon 6, nylon 11, nylon 12, nylon 66, nylon 69, nylon 610, nylon 612, and copolymer nylons including nylon 6/9, nylon 6/10, nylon 6/12, nylon 6/66, nylon 6/69, and aromatic nylons, such as 6I, 6I/6T, MXD6, MXD6/MXDI as well as blends thereof.

Thermoplastic polyesters may include those obtained from an acid component having an aromatic dibasic acid, such as terephthalic acid or isophthalic acid, and a glycol component comprising an aliphatic glycol, an alicyclic glycol or an aromatic glycol, such as ethylene glycol, diethylene glycol or cyclohexane dimethanol. A co-polyester, formed starting from two or three species of acid component or/and of glycol component, may be used.

Polyolefin resins for the outer layer (b) may be ethylene homo-polymers and ethylene co-polymers. Resins may be ethylene-α-olefin copolymers, particularly those with a density of from about 0.895 to about 0.935 g/cm$^3$, and may be a density of from about 0.900 and about 0.930 g/cm$^3$, ethylene-vinyl acetate copolymers, particularly those with a vinyl acetate content of from about 4 to about 14% by weight, ionomers, and their blends.

The thickness of the outer layer (b) typically depends on the number of layers in the overall structure and on their thickness in view of the total thickness desired for the flexible container. It will thus generally include between about 2 and about 20 μm, or may include between about 3 and about 15 μm.

According to an embodiment of the present invention, the multi-layer film also includes a core gas-barrier layer (d) that may include at least one gas barrier resin generally selected from vinylidene chloride copolymers (PVDC), ethylene-vinyl alcohol copolymers (EVOH), polyamides and acrylonitrile-based copolymers. Resins may typically include PVDC, EVOH, polyamides/copolyamides and blends of EVOH with polyamides/copolyamides.

One resin may be PVDC. PVDC includes copolymers of vinylidene chloride and at least one mono-ethylenically unsaturated monomer copolymerizable with vinylidene chloride. The mono-ethylenically unsaturated monomer may be used in a proportion of 2-40 wt. %, or may be 4-35 wt. %, of the resultant PVDC. Examples of the mono-ethylenically unsaturated monomer may include vinyl chloride, vinyl acetate, vinyl propionate, alkyl acrylates, alkyl methacrylates, acrylic acid, methacrylic acid, and acrylonitrile. The vinylidene chloride copolymer can also be a ter-polymer. A copolymer with vinyl chloride or ($C_1$-$C_8$)-alkyl(meth)acrylate, such as methyl acrylate, ethyl acrylate or methyl methacrylate, as the comonomers may be used. It is also possible to use a blend of different PVDC such as for instance a blend of the copolymer of vinylidene chloride with vinyl chloride with the copolymer of vinylidene chloride with methyl acrylate. The PVDC may contain suitable additives known in the art, i.e.stabilisers, antioxidizers, plasticizers, hydrochloric acid scavengers, etc. that may be added for processing reasons or/and to control the gas-barrier properties of the resin.

Ethylene-vinyl alcohol copolymers may be employed when a particularly good flexibility is required or when a fully coextruded, irradiated structure is manufactured because EVOH withstands irradiation without being degraded, up to a very high energy level. It may be used alone or admixed with a polyamide or copolyamide. Polyamides and copolyamides can also be employed alone as gas-barrier resins. The aromatic polyamides/copolyamides, such as the polyamide formed by polycondensation between methaxylyenediamine and adipic acid, the polyamide formed from hexamethylenediamine and terephthalic acid and/or isophthalic acid and the copolyamide formed from methaxylyenediamine, adipic acid and isophthalic acid may be used. In general, amorphous or semi-crystalline polyamides/copolyamides may be used.

Once the gas-barrier resin has been selected, its thickness may be set to provide for the desired oxygen transmission rate (OTR). High barrier structures may have an OTR below 100 cm$^3$/day.m$^2$.atm or may be below 80 cm$^3$/day.m$^2$.atm and may be particularly suitable for meat packaging, including fresh red meat and processed meat. Higher OTR may be used for packaging cheeses or the like where generally OTR of from about 100 to about 400 cm$^3$/day.m$^2$.atm or from about 150 to about 350 cm$^3$/day.m$^2$.atm may be used.

Typically, the thickness of the barrier layer may range from about 2 to about 10 μm, from about 3 to about 8 μm, or from about 3.5 to about 7 μm.

Additional layers, such as for instance tie layers, used to improve interlayer adhesion, may be present.

Tie layers may be disposed between the respective layers where a sufficient adhesion is not ensured between adjacent layers. The adhesive resin may include one or more polyolefins, one or more modified polyolefins or a blend of the above. Specific, not limitative, examples thereof may include: ethylene-vinyl acetate copolymers, ethylene-(meth)acrylate copolymers, ethylene-α-olefin copolymers, any of the above modified with carboxylic or anhydride functionalities, elastomers, and a blend of these resins.

If the structure contains tie layers, the tie layers' thickness may generally be between about 0.5 and about 7 μm, or between about 2 and about 5 μm.

Other layers may be present in the overall structure such as bulky structural layers to increase the thickness of the overall structure as desired, oxygen scavenging layers, additional gas-barrier layers, etc. as known in the art.

Typically, the overall thickness of the film for use in the manufacture of the flexible containers of the present invention may be between about 0.001 inches and 0.006 inches, between about 0.0015 inches and 0.004 inches, or between about 0.0018 inches and 0.003 inches. The quality of the unshrunk film may have a tensile strength in the longitudinal direction of 12,800 lbs/in$^2$ and a tensile strength in the transverse direction of 10,200 lbs/in$^2$.

In all the film layers, the polymer components may contain appropriate amounts of additives normally included in such compositions. Some of these additives may be included in the outer layers or in one of the outer layers, while some others may be included in the outer layers or in one of the outer layers, while some others are added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, antistatic agents, anti-fog agents or compositions, and the like additives known to those skilled in the art of packaging films.

It should be noted that the various embodiments may include types of film layers other than those described above for the first outer layer, internal layer, and second outer layer, particularly those that have a higher tensile strength. Depending on the strength of the seal and the positioning of the openings, embodiments of the invention may not require the cohesive failure of the film layers.

The films according to the present invention may be heat-shrinkable or non-shrink.

The films may show a percent free shrink in each direction of at least 10% at 95° C., or they may show a percent free shrink at 95° C. higher than 20% in at least one direction, or a percent free shrink at 95° C. higher than 20% in each direction.

Films may also be those showing a percent free shrink higher than 10% in each direction at a temperature of 90° C. and may be those showing a percent free shrink higher than 10% in each direction at a temperature of 85° C.

The films, according to the present invention, can be manufactured by the so-called trapped-bubble process, which is a known process typically used for the manufacture of heat-shrinkable films for food contact packaging. According to the trapped-bubble process, the multilayer film may be co-extruded through a round die to obtain a tube of molten polymeric material that can be quenched immediately after extrusion without being expanded, optionally cross-linked, then heated to a temperature that is above the Tg of all the resins employed and below the melting temperature of at least one of the resins employed, typically by passing it through a hot water bath, or alternatively by passing it through an IR oven or a hot air tunnel, and expanded, still at this temperature, by internal air pressure to get the transversal orientation and by a differential speed of the pinch rolls, which hold the thus obtained "trapped bubble", to provide the longitudinal orientation. Typical orientation ratios may be between about 2 and about 6 in each direction or between about 3 and about 5 in each direction. After being stretched, the film may be quickly cooled while substantially retaining its stretched dimensions to somehow freeze the molecules of the film in their oriented state and rolled for further processing.

Cross-linking is typically obtained by passing the flattened tubing through an irradiation vault where it is irradiated by high-energy electrons. Depending on the characteristics desired, this irradiation dosage can vary from about 20 to about 200 kGy or from about 30 to about 150 kGy.

Depending on the number of layers in the structure, it may be advisable or necessary to split the co-extrusion step: a tube may first be formed of a limited number of layers, with layer (a) on the inside of the tube; this tube will be quenched quickly and, before submitting it to the orientation step, will be extrusion-coated with the remaining layers, again quenched quickly, optionally cross-linked, and then passed to the orientation. During the extrusion-coating, the tube may be slightly inflated just to keep it in the form of a tube and avoid collapse. By coextruding all the remaining layers altogether, the coating step can simultaneously adhere all of the layers, one over the other, to the quenched tube obtained in the first coextrusion step or can be repeated as many times as the number of layers that are to be added.

The extrusion-coating step may also be required when a film, which is only partially cross-linked, is desired. As an example, in the case of barrier structures including a PVDC layer, which might be degraded/discolored by irradiation, it may be desirable to avoid cross-linking of the PVDC layer. In this case, the irradiation step may be performed after the extrusion of the first group of layers, which would not comprise the PVDC barrier layer, and before the extrusion-coating.

Alternatively, the film, according to the present invention, may be obtained by flat extrusion (co-extrusion or extrusion coating) and biaxial stretching by a simultaneous or a sequential tenter process.

Still alternatively, the film, according to the present invention, may be obtained by heat- or glue-laminating separately-obtained webs each containing only part of the film sequence of layers.

In an embodiment, the film may be obtained as a seamless tubular film, which may then be converted into end-sealed bags by transversely sealing and severing across the seamless tubular film as it lays flat. Alternatively, the film may be converted into transverse-sealed bags by slitting the seamless tubular film along one of its edges and then transversely sealing and severing the thus obtained center-folded film into bags, where the side seals are the sealing and severing seams and the bottom of the bag is the unslit edge of the film.

Other bag and pouch making methods known in the art may be readily adapted to make receptacles from the multilayer film according to the present invention.

The seal(s) along the bottom and/or side edges of the flexible containers of the invention can be at the very edge itself (e.g., seals of a type commonly referred to in this art as "trim seals" where sealing of, for example, the bottom of one flexible container will generate the open mouth of the following flexible container and, in such a case, the opening tabs to be grasped when opening of the package is desired may be created in the flexible container portion that extends beyond the seal closing the open mouth of the package). However, in general, the heat seals may be made using an impulse-type heat-sealing apparatus which utilizes a heat-sealing bar that is quickly heated and then quickly cooled. The heat-sealing bar may be straight or possibly shaped, e.g., typically with a curved shape, and may be associated with cutting means, generally parallel to the sealing bar and at a short distance thereof. The heat-sealing means and the cutting means may operate simultaneously. In other words, while the heat-sealing means may seal the bottom of one flexible container, the associated cutting means may create the open mouth on another portion of the flexible container. This may generate flexible containers where the seals are spaced inwardly (roughly 0.5-1.5 cm) from the container side and/or bottom edges with a so-called "skirt" of the unsealed front and rear panels extending beyond the seal and having a dimension corresponding to the distance between the sealing means and the cutting means. When a flexible container, according to an embodiment of the present invention, is desired and where suitably shaped opening tabs of unsealed material extend beyond one of the heat seals, it may be sufficient to modify the profile of the cutting means accordingly, while maintaining the shape of the heat-sealing bar. In addition, the cutting means can be configured to form the openings in the opening tabs as discussed below.

In both cases, in order to get the best results in terms of easy openability of the package, the width of the seal, be it a heat seal or a seal made in the packaging process to close the mouth of the package, may be less than about 4 mm, less than about 3.5 mm, and typically including between about 1 and about 3 mm, e.g., 1 to 2 mm.

An easy-openable, hermetically sealable, flexible container according to the present invention has wide applications, particularly for food packaging applications, e.g., for the packaging of meat, such as beef and poultry, processed meat, such as ham, mortadella, wurstel, and dairy products, particularly hard cheeses. The flexible container may have heat-sealing properties that allow it to survive the process of being filled, evacuated, sealed, closed, heat shrunk, boxed, shipped, unloaded, and stored at the retail supermarket, without losing the hermeticity, while it may also have an easy opening feature that may allow opening of the package by hand, i.e., without using scissors, knives, or other cutting and dangerous devices, when this is desired.

What is claimed is:

1. A flexible container for containing a product comprising:

a plastic film formed into an enclosure for receiving a product and defining at least one openable portion;

a hermetic seal closing the openable portion of the enclosure;

a first opening-tab extending beyond the seal outside of the enclosure and a second opening-tab extending beyond the seal outside the enclosure, wherein the plastic film is formed into the opening-tabs such that the opening-tabs integrally extend from the enclosure; and at least one of the first and second opening tabs having two openings arranged adjacent to each other to thereby concentrate opening stress on the hermetic seal so that the hermetic seal is torn and the flexible container is opened when the opening-tabs are pulled, and wherein the plastic film comprises a first outer heat-sealing layer, a second outer layer, and an internal cohesive failure layer.

2. The flexible container of claim 1 further comprising at least two openings in each of said first and second tabs.

3. The flexible container of claim 2 wherein each of the first and second tabs has three or more openings.

4. The flexible container of claim 1 wherein at least one of the openings has rounded edges.

5. The flexible container of claim 1 wherein at least one of the openings comprises a slit.

6. The flexible container of claim 5 further comprising at least one slit on each of the first and second tab.

7. The flexible container of claim 6 wherein each of the first and second tabs has two slits.

8. The flexible container of claim 1 wherein the hermetic seal closing the open portion of the enclosure is a continuous heat seal that extends from a first edge of the flexible container to a second edge of the flexible container.

9. A flexible container according to claim 1 comprising a product.

10. A flexible container for containing a product comprising:

a plastic film formed into an enclosure for receiving a product and defining at least one openable portion;

a hermetic seal closing the openable portion of the enclosure;

a first opening-tab extending beyond the seal outside of the enclosure, and a second opening-tab extending beyond the seal outside the enclosure, wherein the plastic film is formed into the opening-tabs such that the opening-tabs integrally extend from the enclosure; and at least one of the first and second opening tabs having two openings positioned adjacent to each other to define a stressed film region between the openings, and wherein the stressed film region concentrates opening stress on the hermetic seal so that the hermetic seal is torn and the flexible container is opened when the tabs are pulled, and wherein the plastic film comprises a first outer heat-sealing layer, a second outer layer, and an internal cohesive failure layer.

11. The flexible container of claim 10 wherein the stressed film region defines a minimum width between adjacent openings, and wherein the minimum width of the stressed film region has a tensile strength that exceeds the force required to open the container.

12. The flexible container of claim 11 wherein the force required to open the container is less than 14 lbf.

13. The flexible container of claim 11 wherein the minimum width of the stressed film region is 9/16 of an inch.

14. The flexible container of claim 10 wherein the plastic film has a thickness between about 0.001 inches and 0.006 inches.

15. A flexible container for containing a product comprising:

a plastic film formed into an enclosure for receiving a product and defining at least one openable portion;

a hermetic seal closing the openable portion of the enclosure and defining a seal direction;

a first opening-tab extending beyond the seal outside of the enclosure, and a second opening-tab extending beyond the seal outside the enclosure, wherein the plastic film is formed into the opening-tabs such that the opening-tabs integrally extend from the enclosure; and at least one of the first and second opening tabs having at least two openings, wherein two or more of the openings are positioned adjacent to each other, and further wherein two of the adjacent openings each further defines, an inner edge extending generally perpendicular to the seal direction and generally parallel to the inner edge of the adjacent opening so as to define a stressed film region between the openings, and a guide edge adjacent to the inner edge and defining an angle with respect to the inner edge for receiving a finger of a user and guiding that finger towards the inner edge of the opening due to the angle defined between the guide edge and the inner edge so that the stressed film region concentrates opening stress on the hermetic seal and the flexible container is opened when the tabs are pulled by the user; and wherein the plastic film comprises a first outer heat-sealing layer, a second outer layer, and an internal cohesive failure layer.

16. The flexible container of claim 15 wherein the guide edges of each of the adjacent openings define an acute angle with the respective inner edges of the opening so as to define a generally wedge-shaped opening.

17. The flexible container as defined in claim 16 wherein each adjacent opening defines a third edge extending between the inner edge and the guide edge.

18. The flexible container of claim 15 wherein the stressed film region defines a minimum width between adjacent openings, and wherein the minimum width of the stressed film region has a tensile strength that exceeds the force required of the user to open the container.

19. The flexible container of claim 15 wherein the film has a thickness between about 0.001 inches and 0.006 inches.

* * * * *